US006745928B2

(12) United States Patent
Ishizawa et al.

(10) Patent No.: US 6,745,928 B2
(45) Date of Patent: Jun. 8, 2004

(54) TRIGGER VALVE APPARATUS FOR PNEUMATIC TOOL

(75) Inventors: Yoshinori Ishizawa, Hitachinaka (JP); Masanori Aoki, Hitachinaka (JP); Hiroki Kitagawa, Hitachinaka (JP)

(73) Assignee: Hitachi Co., Ltd (JP)

( * ) Notice: Subject to any disclaimer, the term of this patent is extended or adjusted under 35 U.S.C. 154(b) by 66 days.

(21) Appl. No.: 09/767,823

(22) Filed: Jan. 24, 2001

(65) Prior Publication Data

US 2001/0009260 A1 Jul. 26, 2001

(30) Foreign Application Priority Data

Jan. 24, 2000 (JP) ..... 2000-014765
Jan. 24, 2000 (JP) ..... 2000-014766

(51) Int. Cl.[7] ..... B25C 5/06
(52) U.S. Cl. ..... 227/130; 227/8
(58) Field of Search ..... 227/130, 8

(56) References Cited

U.S. PATENT DOCUMENTS 3,559,449 A * 2/1971 Steinmetz ..... 72/430
3,771,710 A * 11/1973 Perkins et al. ..... 277/130
3,808,620 A * 5/1974 Rothfuss et al. ..... 227/130
3,969,989 A * 7/1976 Maurer et al. ..... 227/130
4,122,904 A * 10/1978 Haytayan ..... 173/127
4,211,352 A * 7/1980 Zilka ..... 227/130
4,404,894 A * 9/1983 Oesterle ..... 137/625.69
4,436,237 A * 3/1984 Vornberger et al. ..... 227/130
5,687,897 A * 11/1997 Fa et al. ..... 227/8
5,715,986 A * 2/1998 Sauer ..... 227/130
5,785,228 A * 7/1998 Fa et al. ..... 227/130
5,836,501 A * 11/1998 Lai ..... 227/8
5,850,961 A * 12/1998 Braun et al. ..... 227/130
5,924,621 A * 7/1999 Hung ..... 227/130

FOREIGN PATENT DOCUMENTS

JP 51-34144 9/1976
JP 8-336769 12/1996

* cited by examiner

*Primary Examiner*—John Sipos
*Assistant Examiner*—Louis Tran
(74) *Attorney, Agent, or Firm*—Connolly, Bove Lodge & Hutz LLP

(57) ABSTRACT

A plunger is shiftable in response to a trigger operation by a user. A valve piston has a valve piston chamber therein for slidably accommodating the plunger and an axial bore into which the plunger is inserted. An air passage connects the valve piston chamber to an atmosphere via a clearance between the plunger and the axial bore of the valve piston. A seal member is provided to seal the clearance between the plunger and the axial bore of the valve piston. And, a relief passage is formed on at least one of the plunger and the axial bore of the valve piston to open the air passage, thereby allowing compressed air to exit from the valve piston chamber to the atmosphere under a condition where the plunger is engaged with the axial bore of the valve piston.

34 Claims, 19 Drawing Sheets

TRIGGER VALVE APPARATUS FOR PNEUMATIC TOOL

BACKGROUND OF THE INVENTION

The present invention relates to a trigger valve apparatus preferably employed in a pneumatic tool, such as a nailar or a similar pneumatic tool.

FIG. 17 shows a conventional pneumatic fastener. FIG. 18 shows a trigger valve apparatus employed in the pneumatic fastener shown in FIG. 17.

A trigger valve 106 comprises a plunger 107 shiftable in an axial direction in response to a movement of a trigger 139, and a valve piston 109 shiftable in an opposed direction in response to the shift movement of the plunger 107. The valve piston 109 directly controls compressed air supplied to or discharged from a sleeve valve chamber 108. The trigger valve 106 further comprises valve bushes 110 and 111 supporting the plunger 107 and the valve piston 109 so as to be slidable in the axial direction thereof. A spring 112 is interposed between the plunger 107 and the valve piston 109.

An air passage 116 connects a valve piston chamber 113 and the atmosphere. An O-ring 125, provided at a lower portion of the plunger 107, selectively opens or closes the air passage 116 in accordance with a shift movement of the plunger 107. An air passage 114 connects an accumulator chamber 102 to the valve piston chamber 113. An O-ring 115, provided on a cylindrical surface of an axial bore of the valve piston 109, selectively opens or closes the air passage 114 in response to a shift movement of the plunger 107. An air passage 120 connects the accumulator chamber 102 to the sleeve valve chamber 108 located below a sleeve valve 119. An O-ring 121 selectively opens or closes the air passage 120 in accordance with a shift movement of the valve piston 109. An air passage 147 connects the air passage 120 to the atmosphere. An O-ring 123 selectively opens or closes the air passage 147 in accordance with a shift movement of the valve piston 109. An O-ring 124, coupled around the valve piston 109, seals a clearance between the valve piston 109 and the bush 110. Thus, the valve piston chamber 113 is always isolated from the air passage 147 by the O-ring 124.

When the valve piston 109 is positioned at its top dead center, the accumulator chamber 102 communicates with the sleeve valve chamber 108 while the sleeve valve chamber 108 is isolated from the atmosphere because the air passage 147 is closed by the O-ring 123 as shown in FIG. 19. When the valve piston 109 is positioned at its bottom dead center, the sleeve valve chamber 108 communicates with the atmosphere via the air passage 147 while the sleeve valve chamber 108 is isolated from the accumulator chamber 102 by the O-ring 121 as shown in FIG. 20.

A sleeve valve portion 126, serving as a main valve, comprises a sleeve valve 119, a sleeve valve rubber 127, a sleeve valve spring 128, an exhaust rubber 130, and O-rings 131 and 132. The sleeve valve rubber 127 is coupled around an upper end portion of the sleeve valve 119 so as to selectively connect or disconnect the cylinder 103 to or from the accumulator chamber 102. The sleeve valve spring 128 resiliently urges the sleeve valve 119 toward its top dead center. An air passage 129 is provided for exhausting compressed air from an upper space of the piston 104*a* of the cylinder 103. The exhaust rubber 130 is coupled with the upper portion of the cylinder 103 and selectively brought into contact with the sleeve valve 119 to open or close the air passage 129. The O-rings 131 and 132 are provided to always isolate the sleeve valve chamber 108 from the air passage 129.

When the sleeve valve 119 is lowered, the sleeve valve 119 is brought into contact with the exhaust rubber 130 to close the air passage 129 while the accumulator chamber 102 communicates with the upper space of the piston 104*a* in the cylinder 103. When the sleeve valve 119 is raised, the upper end of the cylinder 103 is closed and the sleeve valve 119 separates from the exhaust rubber 130 to open the air passage 129. The air passage 129 communicates with the atmosphere via an air passage (not shown).

A return air chamber 133, provided around a lower portion of the cylinder 103, stores compressed air to return the driver blade 104*b* to its top dead center. An air passage 135, having a check valve 134, is provided near an axial center of the cylinder 103. An air passage 136 is provided at the lower portion of the cylinder 103. A piston bumper 137 is located near the lower end of the cylinder 103. The piston bumper 137 absorbs excessive energy of the driver blade 104*b* after the driver blade 104*b* has struck the nail 105.

An operating portion 138 comprises a trigger 139 operated by a user, an arm plate 140 positioned between the trigger 139 and the plunger 107, and a push lever 142 extending from the lower end of a nose 141 to the vicinity of the arm plate 140. The push lever 142 is resiliently urged toward the nose 141 and slidable along the nose 141. The plunger 107 is raised upward only when the trigger 139 is pulled by the user and the push lever 142 is shifted against the resilient force with the tip of the push lever 142 being pressed to a member into which the nail 105 is struck.

Hereinafter, an operation of the above-described pneumatic fastener 101 will be explained with reference to FIGS. 17 through 21.

FIGS. 17 and 18 show the pneumatic fastener 101 and the trigger valve 106 in a condition where the accumulator chamber 102 is filled with compressed air. Part of the compressed air stored in the accumulator chamber 102 flows into the valve piston chamber 113 via the air passage 114. The plunger 107 is positioned at its bottom dead center as it receives a differential force caused by a diameter difference between the O-ring 115 and the O-ring 125 as well as a resilient force of the spring 112. Furthermore, part of the compressed air stored in the accumulator chamber 102 flows into the sleeve valve chamber 108 via the air passage 120. The sleeve valve 119 is positioned at its top dead center as it receives a differential force caused by a diameter difference between the sleeve valve rubber 127 and an O-ring 146 as well as another differential force caused by a diameter difference between the O-ring 131 and the O-ring 132 in addition to a resilient force of the sleeve valve spring 128.

FIG. 19 shows a condition of the trigger valve 106 at a moment where the plunger 107 is positioned at its top dead center. The O-ring 115 closes the air passage 114. The valve piston chamber 113 communicates with the atmosphere via the air passage 116. So, the compressed air can go out of the valve piston chamber 113.

FIG. 20 shows a condition of the trigger valve 106 at a moment where the valve piston 109 has moved at its bottom dead center in response to the shift movement of the plunger 107 to its top dead center.

When the pressure in valve piston chamber 113 is substantially equalized with the atmospheric pressure, the valve piston 109 receives a differential force caused by a diameter difference between the O-ring 121 and the O-ring 124 and therefore shifts to its bottom dead center against the resilient force of the spring 112. The O-ring 121 closes the air passage 120. The sleeve valve chamber 108 communicates with the atmosphere via the air passages 120 and 147. The compressed air is exhausted from the sleeve valve chamber 108.

When the pressure in the sleeve valve chamber 108 is substantially equalized with the atmospheric pressure, the sleeve valve 119 receives a differential force caused by a diameter difference between the sleeve valve rubber 127 and the O-ring 146 and therefore starts shifting toward its bottom dead center against the resilient force of the sleeve valve spring 128. When the accumulator chamber 102 communicates with the cylinder 103, the sleeve valve 119 receives a differential force caused by a diameter difference between the O-ring 146 and the exhaust rubber 130. Therefore, the sleeve valve 119 rapidly moves to its bottom dead center.

The exhaust rubber 130 closes the air passage 129. The accumulator 102 communicates with the cylinder 103. The compression air rushes into the upper space of the piston 104*a* in the cylinder 103 from the accumulator chamber 102. The piston 104*a* rapidly shifts downward to its bottom dead center. The driver blade 104*b* integrated with the piston 104*a* strikes the nail 105 into a wood or similar member. The air residing under the piston 104*a* in the cylinder 103 flows into the return air chamber 133 via the air passage 136. After the piston 104*a* has passed the air passage 135, part of the compressed air residing above the piston 104*a* flows into the return air chamber 133 via the air passage 135.

FIG. 21 shows a condition the trigger valve 106 at a moment where the plunger 107 has returned to its bottom dead center. The plunger 107 shifts to its bottom dead center in response to a pressing force of the compressed air in the accumulator chamber 102 as well as the resilient force of the spring 112. The O-ring 125 closes the air passage 116. The compressed air rushes into the valve piston chamber 113 from the accumulator chamber 102 via the air passage 114.

When the compressed air flows into the valve piston chamber 113, the valve piston 109 receives an upward force F1 proportional to a diameter difference (b−a) between the O-ring 124 (diameter=b) and the O-ring 115 (diameter=a) as well as a downward force F2 (<F1) proportional to a diameter difference (b−c) between the O-ring 124 (diameter=b) and the O-ring 123 (diameter=c) in addition to an upward force given by the spring 112.

Therefore, the valve piston 109 shifts to its top dead center. The O-ring 123 disconnects the air passage 120 from the air passage 147. The accumulator chamber 102 communicates with the sleeve valve chamber 108 via the air passage 120. Thus, the compressed air flows into the sleeve valve chamber 108.

When the compressed air flows into the sleeve valve chamber 108, the sleeve valve 119 receives a differential force caused by a diameter difference between the O-ring 131 and the O-ring 146 as well as the resilient force of the sleeve valve spring 128. Therefore, the sleeve valve 119 shifts to its top dead center. When the sleeve valve 119 has reached its top dead center, the sleeve valve rubber 127 isolates the cylinder 103 from the accumulator chamber 102. The exhaust rubber 130 opens the air passage 129. So, the cylinder 103 communicates with the atmosphere. The compressed air stored in the return air chamber 133 pushes the piston 104*a* upward. The piston 104*a* rapidly moves toward its top dead center. The air residing in the upper space of the piston 104*a* is exhausted to the outside (i.e., the atmosphere) via the air passage 129.

According to the arrangement of the above-described conventional pneumatic fastener, the compressed air in the valve piston chamber 113 exits to the outside (i.e., the atmosphere) via the air passage 116. The compressed air in the sleeve valve chamber 108 exits to the outside (i.e., the atmosphere) via the air passage 147. In other words, the exhaust passages for the compressed air are provided near the trigger 139. This in not desirable in that the exhaust air blows fingers of the user.

U.S. Pat. No. 3,808,620 discloses a remote valve arrangement for a pneumatic tool according to which compressed air actuating a trigger valve is exhausted toward a trigger. Thus, user's fingers are subjected to the exhaust air.

SUMMARY OF THE INVENTION

An object of the present invention is to provide an improved arrangement for an exhaust passage of compressed air used for controlling a pneumatic tool.

Another object of the present invention is to provide an improved trigger valve apparatus employed in a pneumatic tool which is capable of preventing O-rings from falling off.

In order to accomplish the above and other related objects, the present invention provides a first trigger valve apparatus for a pneumatic tool driven by compressed air to drive a nail or similar member. According to the first trigger valve apparatus, a plunger is shiftable in response to a trigger operation by a user. A valve piston has a valve piston chamber therein for slidably accommodating the plunger and an axial bore into which the plunger is inserted. An air passage connects the valve piston chamber to an atmosphere via a clearance between the plunger and the axial bore of the valve piston. A seal member is provided to seal the clearance between the plunger and the axial bore of the valve piston. And, a relief passage is formed on at least one of the plunger and the axial bore of the valve piston to open the air passage, thereby allowing compressed air to exit from the valve piston chamber to the atmosphere under a condition where the plunger is engaged with the axial bore of the valve piston.

According to a preferred embodiment of the present invention, the seal member is coupled around the plunger and guided along the axial bore of the valve piston. The relief passage is formed at least partly on a surface of the axial bore of the valve piston so as to open the air passage when the plunger is positioned at a predetermined position to exhaust compressed air from the valve piston chamber to the atmosphere under a condition where the seal member is brought into contact with the axial bore of the valve piston.

Preferably, the relief passage consists of axially extending and alternately arranged guides and grooves formed on the axial bore of the valve piston. The grooves extend in an axial direction of the valve piston and are angularly spaced each other so as to form the guides spaced at substantially equal intervals on the surface of the axial bore of the valve piston. The guides cooperatively define an effective diameter of the axial bore of the valve piston along which the seal member is guided. A total cross section of the grooves, formed when the seal member is guided in the axial bore of the valve piston, defines an effective area of the relief passage. The guides hold the seal member while the compressed air is discharged from the valve piston chamber to the atmosphere via the grooves when the air passage is opened via the relief passage.

According to another preferred embodiment of the present invention, the seal member is coupled in an engaging recess of the axial bore of the valve piston. The relief passage is formed at least partly on a cylindrical surface of the plunger so as to open the air passage when the plunger is positioned at a predetermined position to discharge compressed air from the valve piston chamber to the atmosphere under a condition where the seal member is brought into contact with the plunger.

Preferably, the relief passage consists of axially extending and alternately arranged guides and grooves formed on the cylindrical surface of the plunger. The grooves extend in an axial direction of the plunger and are angularly spaced each other so as to form the guides spaced at substantially equal intervals on the cylindrical surface of the plunger. The guides cooperatively define an effective diameter of the plunger. A total cross section of the grooves, formed when the plunger is guided by the seal member provided on the axial bore of the valve piston, defines an effective area of the relief passage. The guides hold the seal member while the compressed air is discharged from the valve piston chamber to the atmosphere via the grooves when the air passage is opened via the relief passage.

Furthermore, the present invention provides a second trigger valve apparatus for a pneumatic tool driven by compressed air to drive a nail or similar member. According to the second trigger valve apparatus, a plunger is shiftable in response to a trigger operation by a user. A valve bush has an axial bore into which the plunger is slidably inserted. A valve piston is slidably supported by the valve bush to form a valve piston chamber for accommodating the plunger. An air passage connects the valve piston chamber to an accumulator chamber via a clearance between the plunger and the axial bore of the valve bush. A seal member is provided to seal the clearance between the plunger and the axial bore of the valve bush. And, a relief passage is formed on at least one of the plunger and the axial bore of the valve bush to open the air passage, thereby allowing compressed air to enter into the valve piston chamber from the accumulator chamber under a condition where the plunger is engaged with the axial bore of the valve bush.

According to another preferred embodiment of the present invention, the seal member is coupled in an engaging recess of the axial bore of the valve bush. The relief passage is formed at least partly on a cylindrical surface of the plunger so as to open the air passage when the plunger is positioned at a predetermined position to introduce compressed air from the accumulator chamber to the valve piston chamber under a condition where the seal member is brought into contact with the plunger.

Preferably, the relief passage consists of axially extending and alternately arranged guides and grooves formed on the cylindrical surface of the plunger. The grooves extend in an axial direction of the plunger and are angularly spaced each other so as to form the guides spaced at substantially equal intervals on the cylindrical surface of the plunger. The guides cooperatively define an effective diameter of the plunger. A total cross section of the grooves, formed when the plunger is guided by the seal member provided on the axial bore of the valve bush, defines an effective area of the relief passage. The guides hold the seal member while the compressed air is introduced via the grooves into the valve piston chamber from the accumulator chamber when the air passage is opened via the relief passage.

According to another preferred embodiment of the present invention, the seal member is coupled around the plunger and guided along the axial bore of the valve bush. The relief passage is formed at least partly on a surface of the axial bore of the valve bush so as to open the air passage when the plunger is positioned at a predetermined position to introduce compressed air from the accumulator chamber to the valve piston chamber under a condition where the seal member is brought into contact with the axial bore of the valve bush.

Preferably, the relief passage consists of axially extending and alternately arranged guides and grooves formed on the axial bore of the valve bush. The grooves extend in an axial direction of the valve piston and are angularly spaced each other so as to form the guides spaced at substantially equal intervals on the surface of the axial bore of the valve bush. The guides cooperatively define an effective diameter of the axial bore of the valve bush along which the seal member is guided. A total cross section of the grooves, formed when the seal member is guided in the axial bore of the valve bush, defines an effective area of the relief passage. The guides hold the seal member while the compressed air is introduced via the grooves from the accumulator chamber into the valve piston chamber when the air passage is opened via the relief passage.

Preferably, in the above first and second trigger valve apparatus, the seal member is an O-ring.

Moreover, the present invention provides a pneumatic tool comprising a piston driven by compressed air for causing a reciprocative movement to strike a nail or similar member. A cylinder slidably supports the piston. A main valve supplies and discharges compressed air into and from the cylinder. A trigger valve pneumatically controls the main valve. A trigger is provided for actuating the trigger valve and is manipulated by a user. And, at least one exhaust passage is provided for discharging compressed air which is used for pneumatically operating the main valve and the trigger valve. An outlet of the exhaust passage is directed to a portion other than the trigger.

Preferably, in the above-described pneumatic tool, the trigger valve comprises a plunger shiftable in response to a trigger manipulated by the user. A valve piston supplies and discharges compressed air into and from a main valve chamber in response to a shift movement of the plunger responsive to compressed air in a valve piston chamber formed in the valve piston. An air passage is provided for discharging the compressed air from the valve piston chamber and the main valve chamber to the atmosphere, with an outlet of the air passage directed to the portion other than the trigger.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
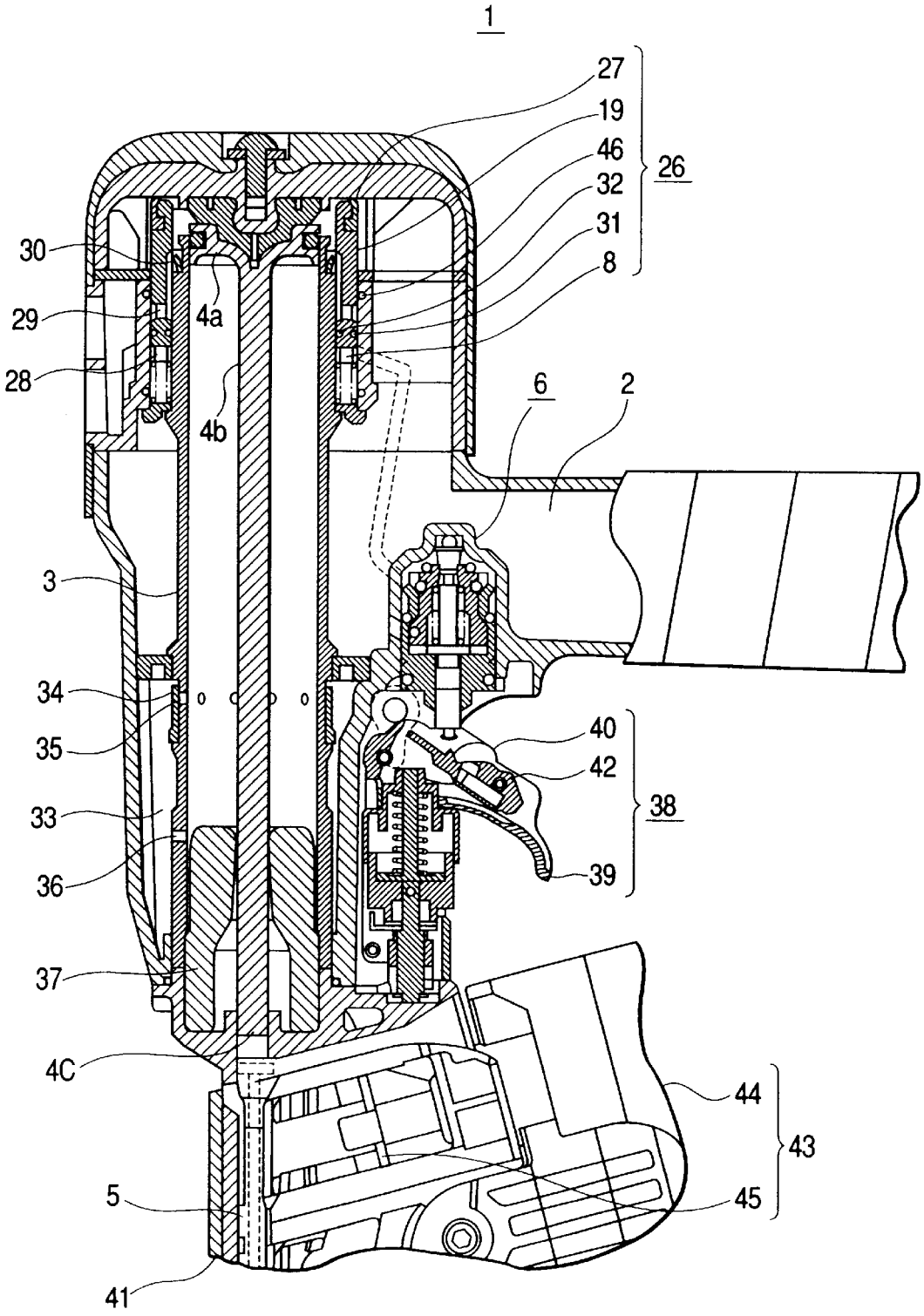
FIG. 1 is a vertical partly cross-sectional view showing A pneumatic fastener in accordance with a preferred embodiment of the present invention.

Preferred embodiments of the present invention will be explained with reference to attached drawings. Identical parts are denoted by the same reference numerals throughout the views. The directions used in the following explanation are defined based on a pneumatic fastener held in a vertical position with a driver bit extending downward and a grip extending horizontally. Needless to say, the actual direction of the pneumatic fastener will be frequently changed due to its handiness when it is used.

Figure 9:
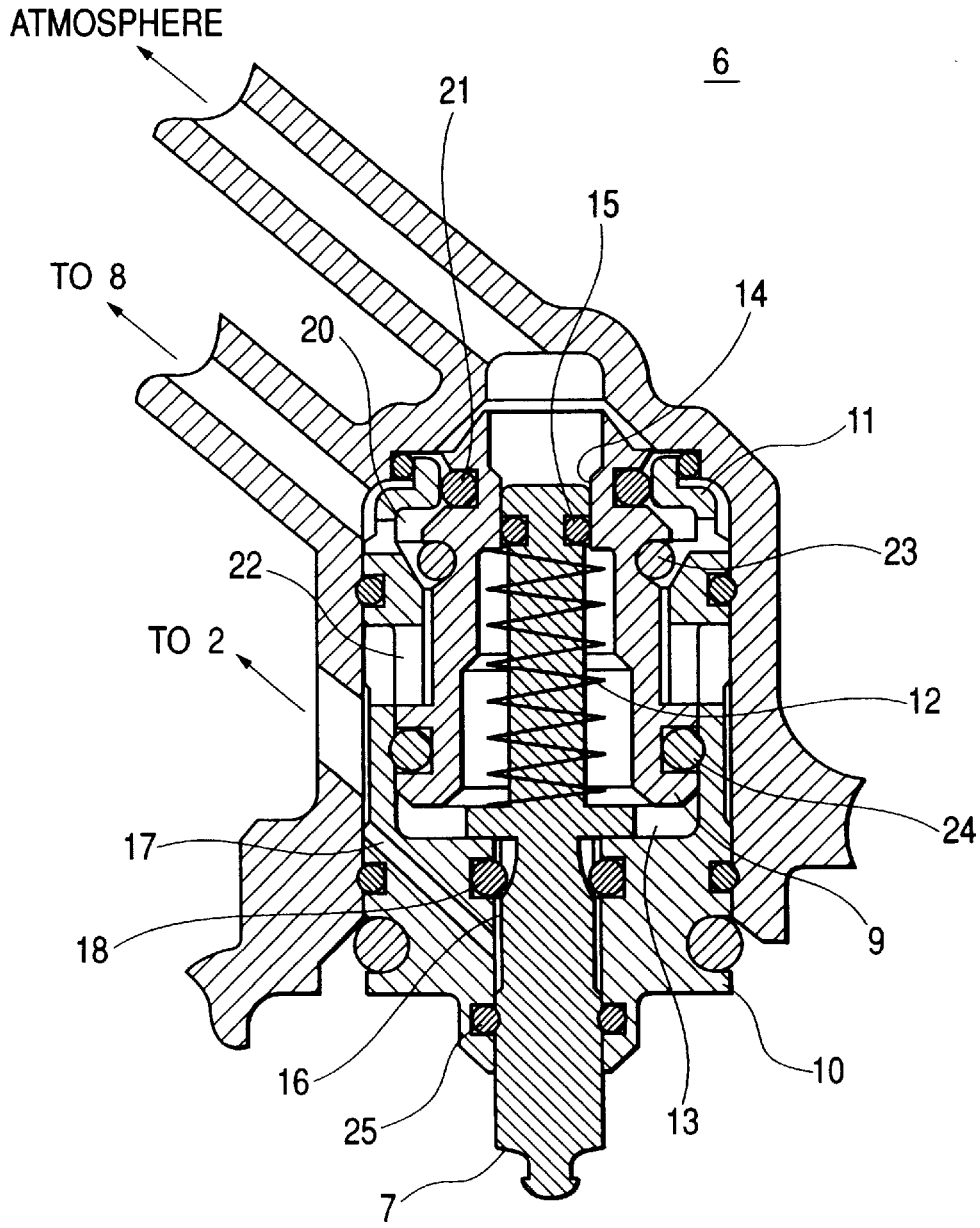
FIG. 9 is a vertical cross-sectional view showing an initial condition of the trigger valve apparatus employed in the pneumatic fastener shown in FIG. 1.

FIGS. 1 and 9 show a pneumatic fastener in accordance with a preferred embodiment of the present invention.

Compressed air, supplied from a compressor (not shown) via an air hose (not shown), is temporarily stored in an accumulator chamber 2 in a pneumatic fastener 1. A circular cylinder 3 is provided in the pneumatic fastener 1. A piston 4*a*, accommodated in the cylinder 3, is slidable in an axial direction of the cylinder 3. A driver blade 4*b* is integrated with the piston 4*a*. A tip 4*c* of the driver blade 4*b* hits the head of a nail 5.

A trigger valve 6 comprises a plunger 7 shiftable in an axial direction (i.e., an up-and-down direction) in response to a movement of a trigger 39 operated by a user, and a valve piston 9 shiftable in an opposed direction in response to the shift movement of the plunger 7. The valve piston 9 directly controls compressed air supplied to or discharged from a sleeve valve chamber 8. The valve piston 9 is configured into a reversed cup shape or a bell shape to define a valve piston chamber 13 therein. The plunger 7 is accommodated in the valve piston chamber 13. The valve piston 9 has an axial bore at its top center. An upper portion of the plunger 7 is inserted into the axial bore of the valve piston 9.

The trigger valve 6 further comprises valve bushes 10 and 11 supporting the plunger 7 and the valve piston 9 so as to be slidable in the axial direction thereof. A spring 12 is interposed between the plunger 7 and the valve piston 9. An O-ring 15 is coupled around a cylindrical outer surface of the plunger 7 near an upper end of the plunger 7. The O-ring 15 selectively opens or closes an air passage 14 connecting a valve piston chamber 13 to the atmosphere.

An air passage 20 connects the sleeve valve chamber 8 to the atmosphere, and an air passage 22 connects the air passage 20 to the accumulator chamber 2. O-rings 21 and 23 are coupled around an outer surface of the valve piston 9 so as to selectively open or close the air passages 20 and 22. Furthermore, another O-ring 24 is coupled around the valve piston 9 to always isolate the valve piston chamber 13 from the air passage 22.

When the valve piston 9 is positioned at its top dead center, the accumulator chamber 2 communicates with the sleeve valve chamber 8 while the sleeve valve chamber 8 is isolated from the atmosphere. When the valve piston 9 is positioned at its bottom dead center, the sleeve valve chamber 8 communicates with the atmosphere while the sleeve valve chamber 8 is isolated from the accumulator chamber 2.

O-rings 18 and 25 are provided on a cylindrical inner wall of the valve bush 10. The O-ring 18 selectively opens or closes air passages 16 and 17 connecting the valve piston chamber 13 to the accumulator chamber 2. The O-ring 25 always isolates the air passage 16 from the atmosphere.

A sleeve valve portion 26 is provided near the upper end of the cylinder 3 so as to surround the cylinder 3. The sleeve valve portion 26 comprises a sleeve valve 19, a sleeve valve rubber 27, a sleeve valve spring 28, an exhaust rubber 30, and O-rings 31 and 32. The sleeve valve rubber 27 is coupled around the upper portion of the sleeve valve 19 so as to selectively connect or disconnect the cylinder 3 to or from the accumulator chamber 2. The sleeve valve spring 28 resiliently urges the sleeve valve 19 toward its top dead center. An air passage 29 is provided for exhausting compressed air from the upper space of the piston 4*a* of the cylinder 3. The exhaust rubber 30 is coupled with the upper portion of the cylinder 3 and selectively brought into contact with the sleeve valve 19 to open or close the air passage 29. The O-rings 31 and 32 are coupled with the lower portion of the sleeve valve 19 to always isolate the sleeve valve chamber 8 from the air passage 29.

When the sleeve valve 19 is lowered, the sleeve valve 19 is brought into contact with the exhaust rubber 30 to close the air passage 29 while the accumulator chamber 2 communicates with the upper space of the piston 4*a* in the cylinder 3. When the sleeve valve 19 is raised upward, the upper end of the cylinder 3 is closed and the sleeve valve 19 separates from the exhaust rubber 30 to open the air passage 29. The air passage 29 communicates with the atmosphere via an air passage (not shown).

A return air chamber 33, provided around the lower portion of the cylinder 3, stores compressed air to return the driver blade 4*b* to its top dead center. An air passage 35, having a check valve 34, is provided near an axial center of the cylinder 3. An air passage 36 is provided at the lower portion of the cylinder 3. A piston bumper 37 is located near the lower end of the cylinder 3. The piston bumper 37 absorbs excessive energy of the driver blade 4*b* after the driver blade 4*b* has struck the nail 5.

An operating portion 38 comprises the trigger 39 operated by the user, an arm plate 40 positioned between the trigger 39 and the plunger 7, and a push lever 42. Although not clearly shown in the drawing, the push lever 42 extends from the lower end of a nose 41 via a mechanical linkage (not shown) to the vicinity of the arm plate 40. The push lever 42 is resiliently urged toward the nose 41 and slidable along the nose 41. The plunger 7 is raised upward only when the trigger 39 is pulled by the user and the push lever 42 is shifted against the resilient force with the tip of the push lever 42 being pressed to a member into which the nail 5 is struck.

An injecting portion 43 comprises a feeding mechanism 45 feeding nails 5 successively from a magazine 44 to an injection hole 41 in synchronism with a reciprocative motion of the piston 4*a*.

Hereinafter, an operation of the above-described pneumatic fastener 1 will be explained with reference to FIGS. 1 and 8–12.

Figure 8:
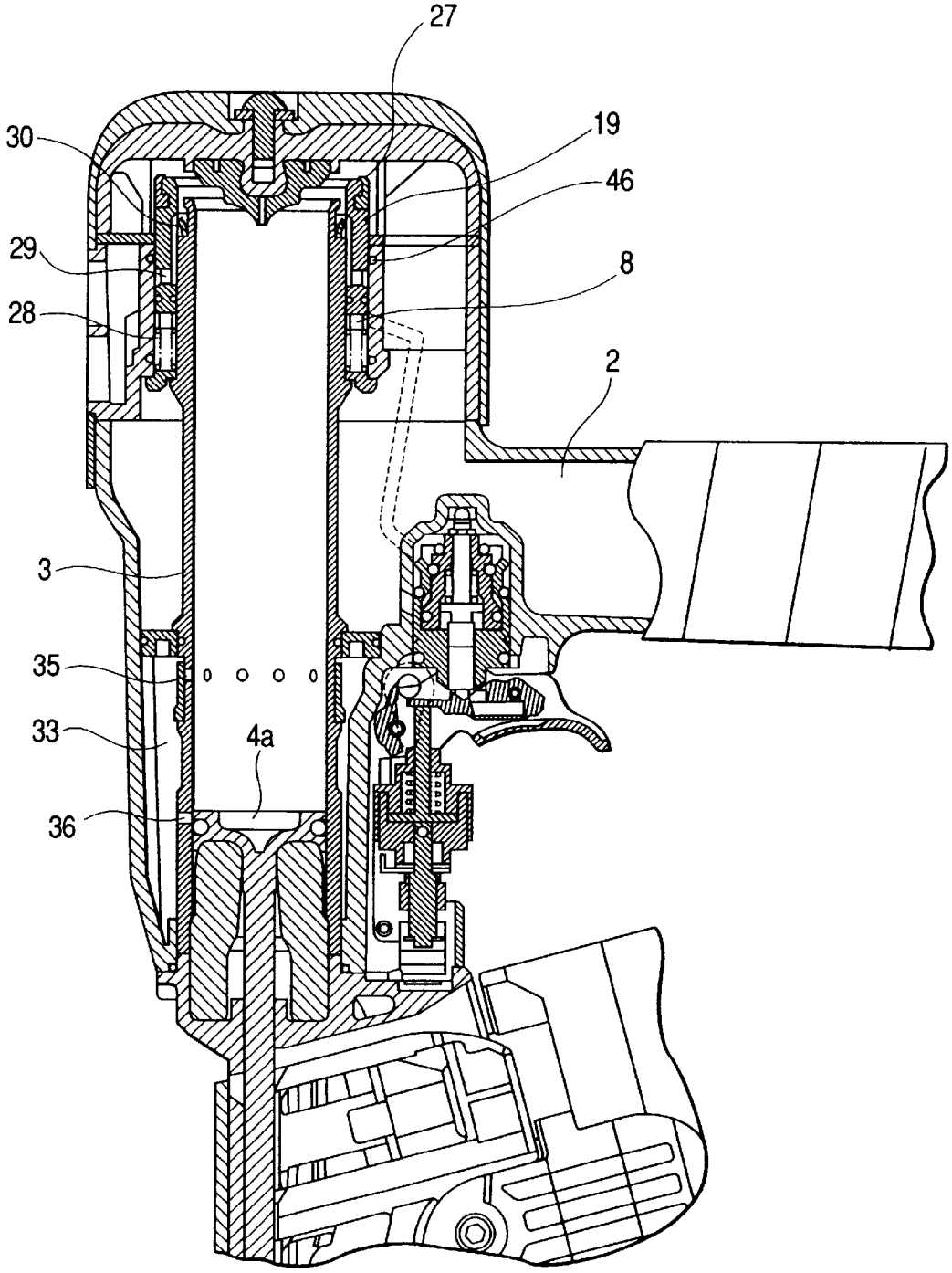
FIG. 8 is a vertical partly cross-sectional view showing an operated condition of the pneumatic fastener shown in FIG. 1, wherein the piston is driven downward from the condition of FIG. 1.

FIGS. 1 and 8 show the pneumatic fastener 1. An air compressor (not shown) supplies compressed air via an air hose (not shown) to the pneumatic fastener 1. An accumulator chamber 2, formed in the body of the pneumatic fastener 1, stores the compressed air. Part of the compressed air stored in the accumulator chamber 2 flows into the valve piston chamber 13 via the air passages 16 and 17. The plunger 7 is positioned at its bottom dead center as it receives a differential force caused by a diameter difference between the O-ring 15 and the O-ring 25 as well as a resilient force of the spring 12. Furthermore, part of the compressed air stored in the accumulator chamber 2 flows into the sleeve valve chamber 8 via the air passage 22. The sleeve valve 19 is positioned at its top dead center as it receives a differential force caused by a diameter difference between the sleeve valve rubber 27 and the O-ring 46 as well as another differential force caused by a diameter difference between the O-ring 31 and the O-ring 32 in addition to a resilient force of the sleeve valve spring 28.

Figure 10:
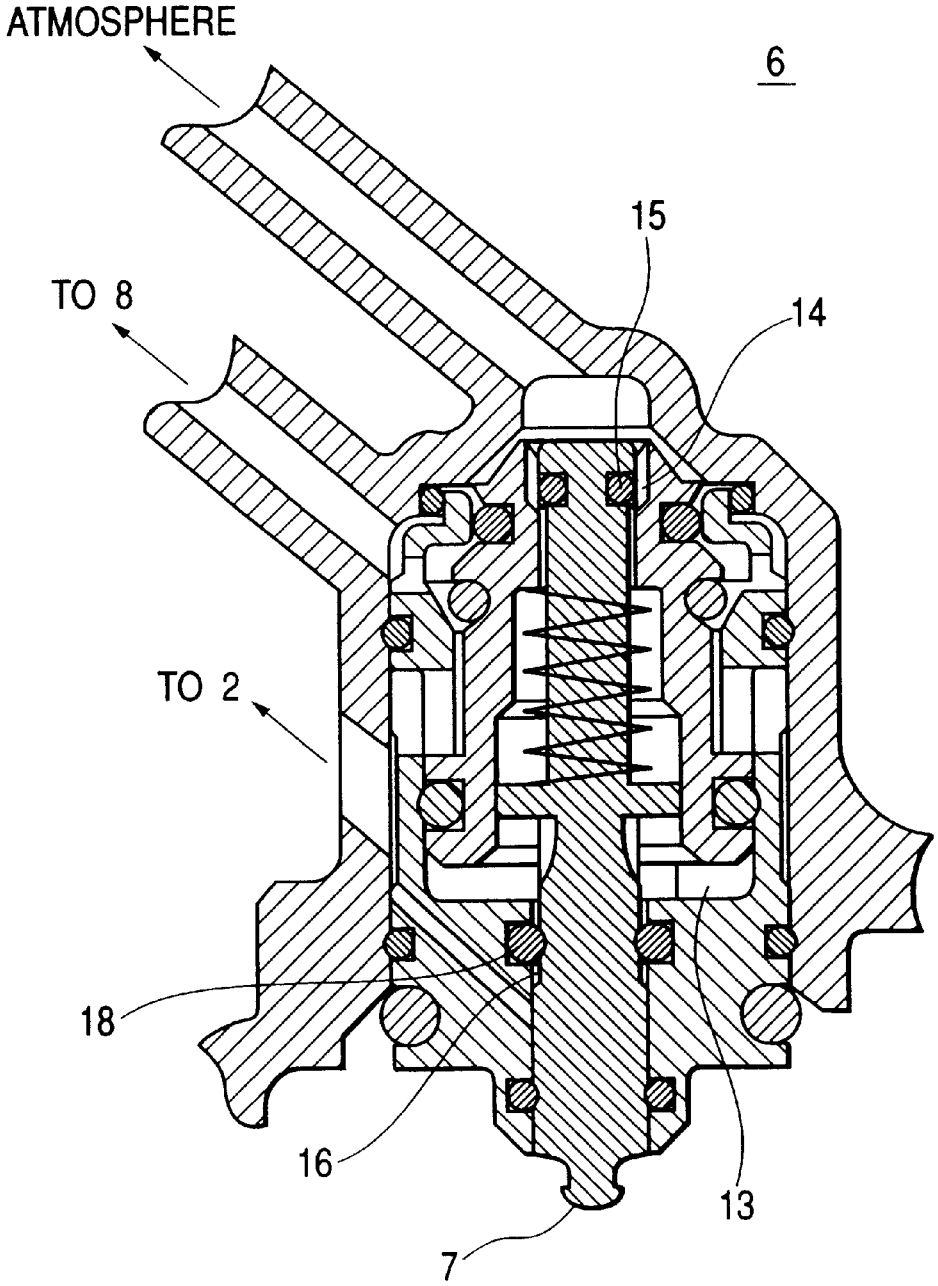
FIG. 10 is a vertical cross-sectional view showing another condition of the trigger valve apparatus shown in FIG. 9, wherein a plunger is pushed up from the initial condition of FIG. 9.

FIG. 10 shows a condition of the trigger valve 6 at a moment where the plunger 7 is positioned at its top dead center in response to the user's pulling operation of the trigger 39 under a condition where the push lever 42 is pressed to the member into which the nail 5 is struck. The O-ring 18 closes the air passage 16, while sealing of the O-ring 15 is unavailable in this condition. Thus, the valve piston chamber 13 communicates with the atmosphere via the air passage 14, so that the compressed air can go out of the valve piston chamber 13. According to this arrangement, the compressed air is discharged upward. Thus, no exhaust air blows fingers of the user.

Figure 11:
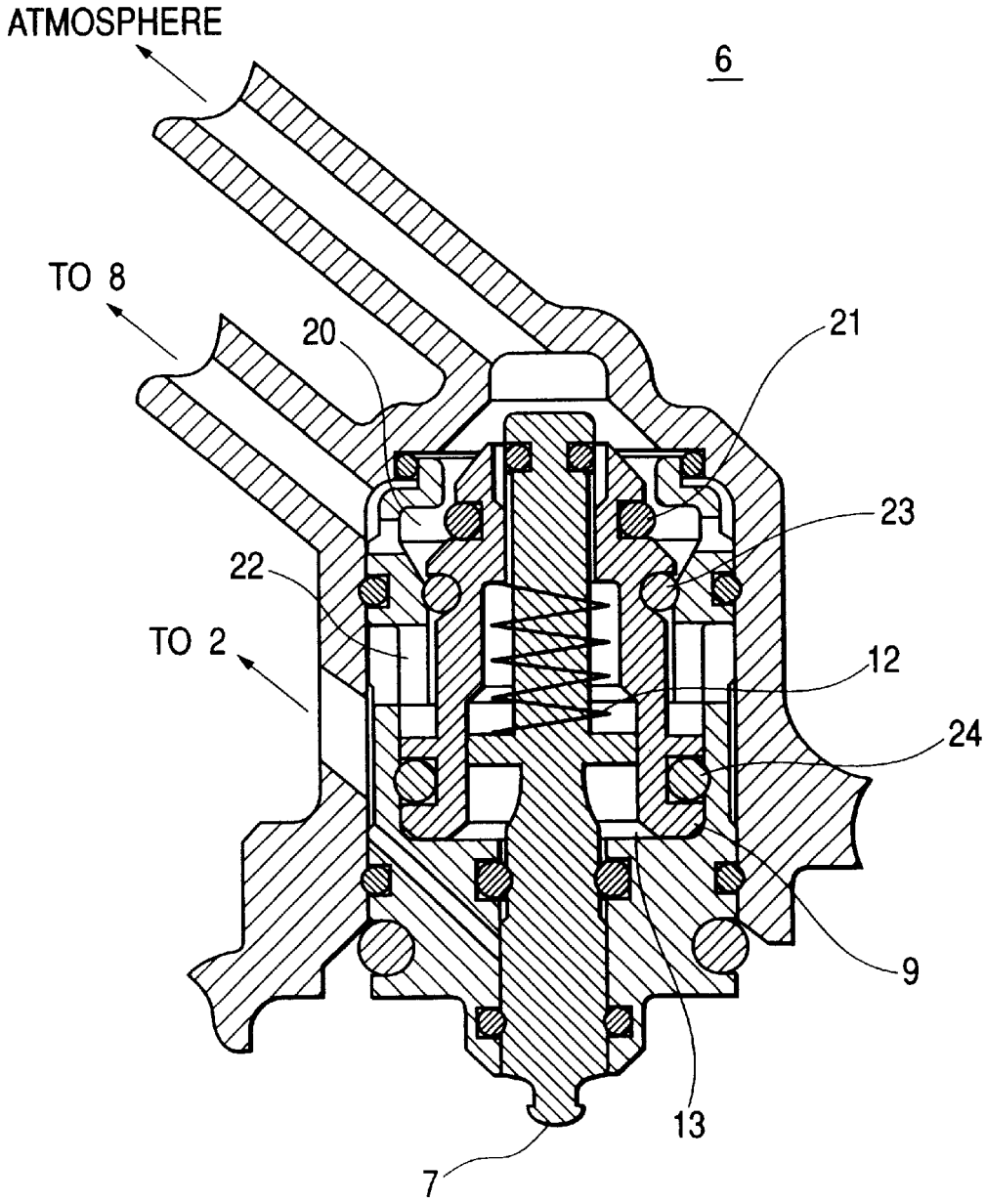
FIG. 11 is a vertical cross-sectional view showing another condition of the trigger valve apparatus shown in FIG. 9, wherein a valve piston is shifted to its bottom dead center from the condition of FIG. 10.

FIG. 11 shows a condition where the valve piston 9 has reached its bottom dead center in response to the shift movement of the plunger 7 to its top dead center.

When the pressure in the valve piston chamber 13 is substantially equalized with the atmospheric pressure, the valve piston 9 receives a differential force caused by a diameter difference between the O-ring 23 and the O-ring 24 and therefore shifts to its bottom dead center against the resilient force of the spring 12. The O-ring 23 disconnects the air passage 22 from the air passage 20. Sealing of the O-ring 21 is unavailable in this condition. The sleeve valve chamber 8 communicates with the atmosphere via the air passage 20. The compressed air goes out of the sleeve valve chamber 8. According to this arrangement, the compressed air is discharged upward. Thus, no exhaust air blows fingers of the user.

FIG. 8 shows a condition where the sleeve valve 19 has reached its bottom dead center in response to the shift movement of the valve piston 9 to its bottom dead center.

When the pressure in sleeve valve chamber 8 is substantially equalized with the atmospheric pressure, the sleeve valve 19 receives a differential force caused by a diameter difference between the sleeve valve rubber 27 and the O-ring 46 and therefore starts shifting toward its bottom dead center against the resilient force of the sleeve valve spring 28. When the accumulator chamber 2 communicates with the cylinder 3, the sleeve valve 19 receives a differential force caused by a diameter difference between the O-ring 46 and the exhaust rubber 30. Therefore, the sleeve valve 19 rapidly moves toward its bottom dead center.

The exhaust rubber 30 isolates the accumulator chamber 2 and the cylinder 3 from the air passage 29, while the accumulator chamber 2 communicates with the cylinder 3. The compression air rushes into the upper space of the piston 4*a* in the cylinder 3 from the accumulator chamber 2. The piston 4*a* rapidly shifts downward to its bottom dead center as shown in FIG. 8. The driver blade 4*b* integrated with the piston 4*a* strikes the nail 5 into a wood or similar member. The air residing under the piston 4*a* in the cylinder 3 flows into the return air chamber 33 via the air passage 36. After the piston 4*a* has passed the air passage 35, part of the compressed air residing above the piston 4*a* flows into the return air chamber 33 via the air passage 35.

Figure 12:
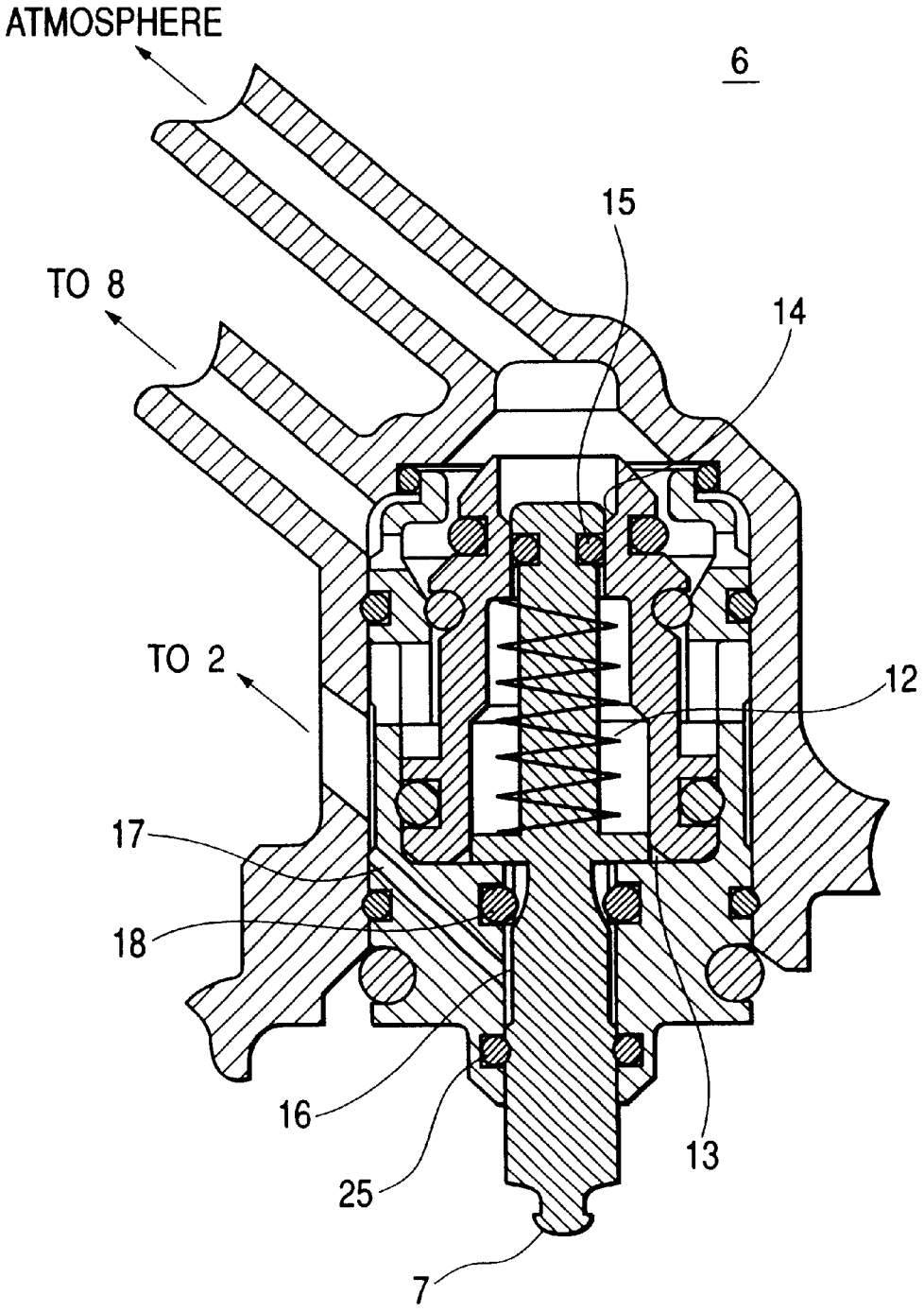
FIG. 12 is a vertical cross-sectional view showing another condition of the trigger valve apparatus shown in FIG. 9, wherein the plunger is returned to the original position from the condition shown in FIG. 11.

FIG. 12 shows another condition of the trigger valve 6 at a moment where the plunger 7 is returned to its bottom dead center in response to the user's releasing operation of the trigger 39 or stop of pushing the push lever 42 to the member into which the nail 5 is struck.

The plunger 7 receives a differential force caused by a diameter difference between the O-ring 15 and the O-ring 25 as well as the resilient force of the spring 12. Therefore, the plunger 7 shifts to its bottom dead center in response to the summed-up force. The O-ring 15 closes the air passage 14, while sealing of the O-ring 18 is unavailable in this condition. The compressed air in the accumulator chamber 2 flows into the valve piston chamber 13 via the air passages 16 and 17.

When the plunger 7 has reached its bottom dead center, the valve piston 9 shifts to its top dead center as shown in FIGS. 1 and 9.

When the compressed air flows into the valve piston chamber 13, the valve piston 9 receives a differential force caused by a diameter difference between the O-ring 23 and the O-ring 24 as well as another differential force caused by a diameter difference between the O-ring 15 and the O-ring 24 in addition to the resilient force of the spring 12. Therefore, the valve piston 9 shifts to its top dead center. The O-ring 21 isolates the air passage 20 from the atmosphere. The accumulator chamber 2 communicates with the sleeve valve chamber 8 via the air passages 20 and 22. Thus, the compressed air flows into the sleeve valve chamber 8.

When the compressed air flows into the sleeve valve chamber 8, the sleeve valve 19 receives a differential force caused by a diameter difference between the O-ring 31 and the O-ring 46 and a resilient force of the sleeve valve spring 28. Therefore, the sleeve valve 19 shifts to its top dead center. The sleeve valve rubber 27 isolates the cylinder 3 from the accumulator chamber 2. A clearance is formed between an inner wall of the sleeve valve 19 and the exhaust rubber 30 when the sleeve valve 19 is raised upward. The cylinder 3 communicates with the air passage 29 via this clearance. The air passage 29 communicates with the atmosphere via an air passage (not shown). As a result, the cylinder 3 communicates with the atmosphere. The compressed air stored in the return air chamber 33 pushes the piston 4*a* upward. The piston 4*a* rapidly moves toward its top dead center. The air residing in the upper space of the piston 4*a* is exhausted to the outside (i.e., the atmosphere) via the air passage 29. Thus, the pneumatic fastener returns to the initial condition.

As described above, the compressed air in the valve piston chamber 13 is exhausted or discharged via the air passage 14. According to this arrangement, no exhaust air blows fingers of the user.

Figure 13:
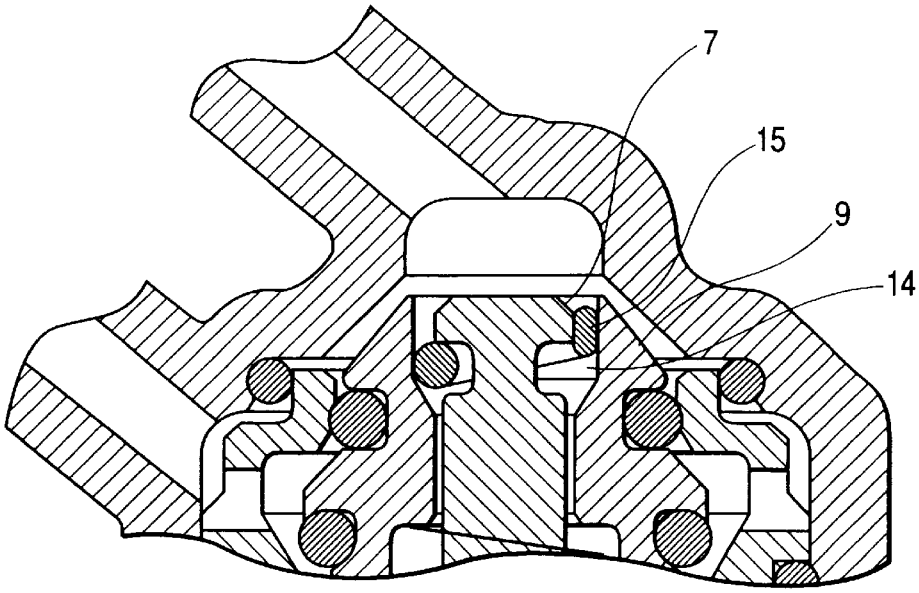
FIG. 13 is a vertical cross-sectional view showing an operation of the trigger valve apparatus shown in FIG. 9.

However, when the compressed air is discharged from the air passage 14 to the outside (i.e., the atmosphere), the jet of the exhaust air may pull the O-ring 15 off an engaging recess of plunger 7 as shown in FIG. 13.

To avoid this, it may be possible to increase the hardness of the O-ring 15. However, increased hardness of the O-ring 15 will increase a slide resistance between the valve piston 9 and the plunger 7. This may induce a defective operation of the trigger valve 6. Furthermore, it will be difficult for a worker at assembling of this trigger valve 6 to couple a hard O-ring in the engaging recess of the plunger 7.

Figure 14:
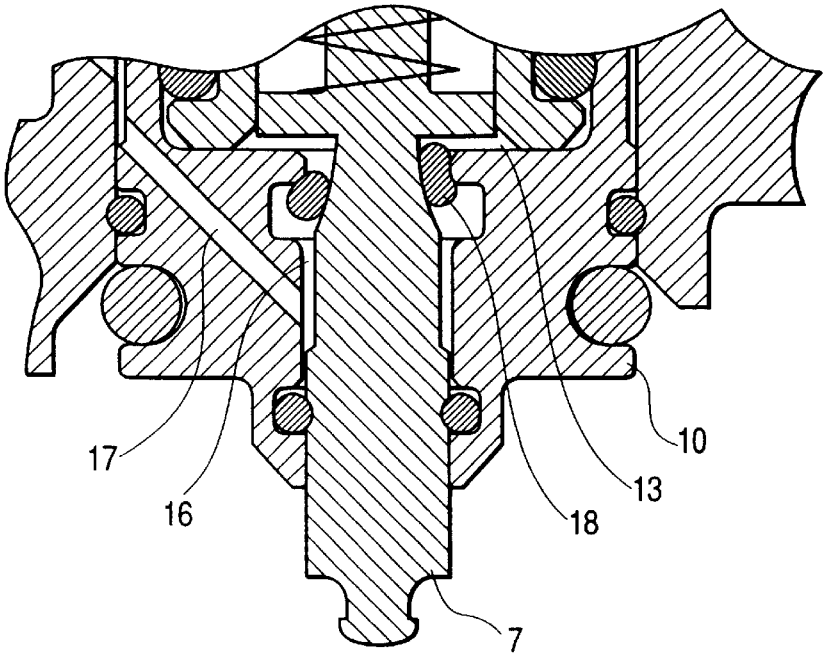
FIG. 14 is a vertical cross-sectional view showing another operation of the trigger valve apparatus shown in FIG. 9.

The same phenomenon will happen on the O-ring 18 coupled in the engaging recess formed on an inner cylindrical wall of an axial bore of the valve bush 10. More specifically, the plunger 7 has a smaller-diameter portion under its flange portion. The O-ring 18 is opposed to this smaller-diameter portion. In a condition where the O-ring 18 does not work as a seal, the compressed air in the accumulator chamber 2 rushes into the valve piston chamber 13 via the air passages 16 and 17. The jet of the introduced air may pull the O-ring 18 off an engaging recess of valve push 10 as shown in FIG. 14. As described above, increasing the hardness of the O-ring 18 possibly increases a slide resistance between the valve bush 10 and the plunger 7. This may induce a defective operation of the trigger valve 6. Furthermore, it will be difficult for the worker at assembling of this trigger valve 6 to couple a hard O-ring in the engaging recess of the valve bush 10.

A preferable embodiment of the trigger valve apparatus will be explained with reference to FIGS. 2 to 4.

An inner cylindrical wall of the axial bore of the valve piston 9 is brought into contact with the O-ring 15 when the plunger 7 is positioned at its top dead center.

Figure 2:
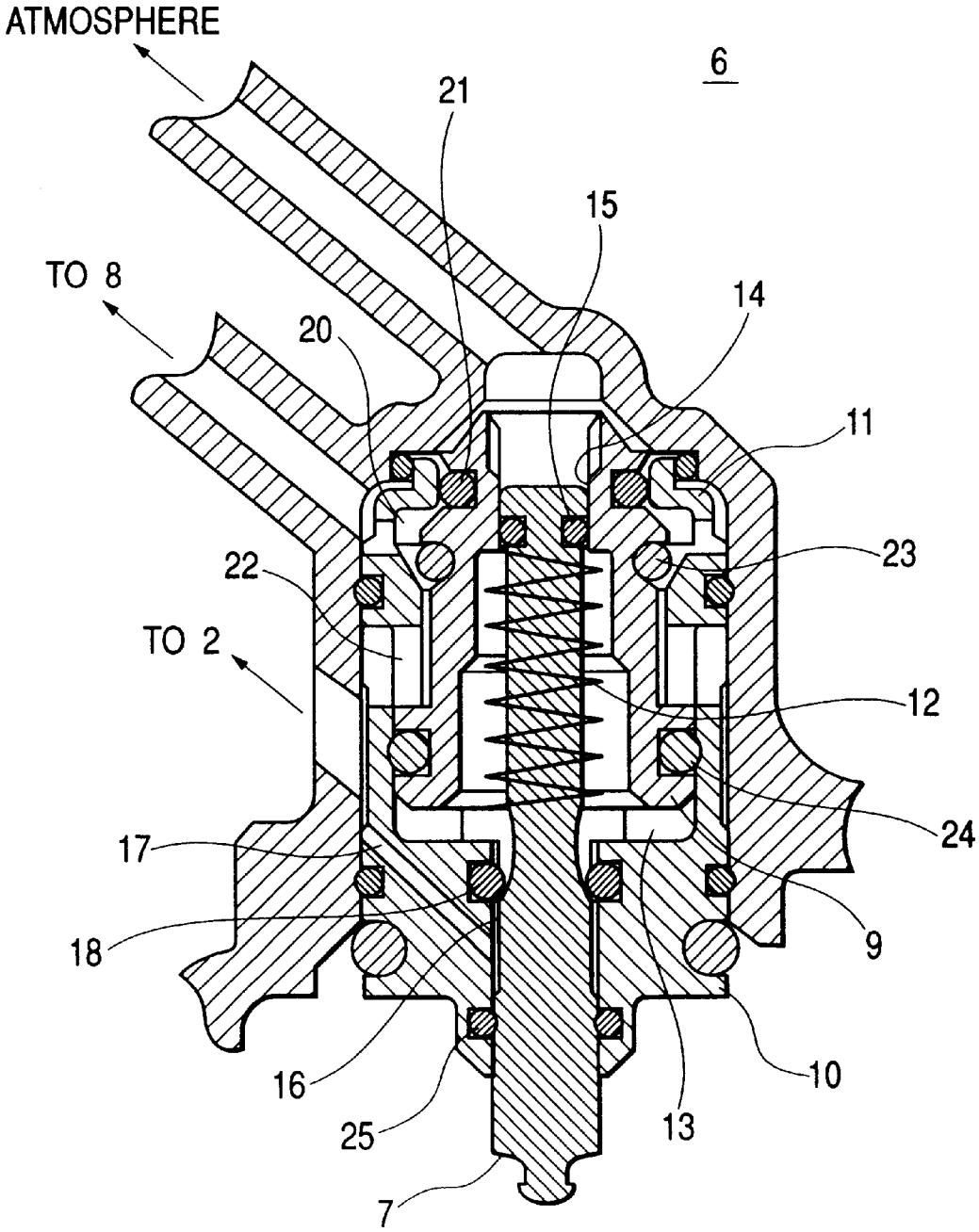
FIG. 2 is a vertical cross-sectional view showing an initial condition of a trigger valve apparatus in accordance with a preferred embodiment of the present invention.
Figure 3:
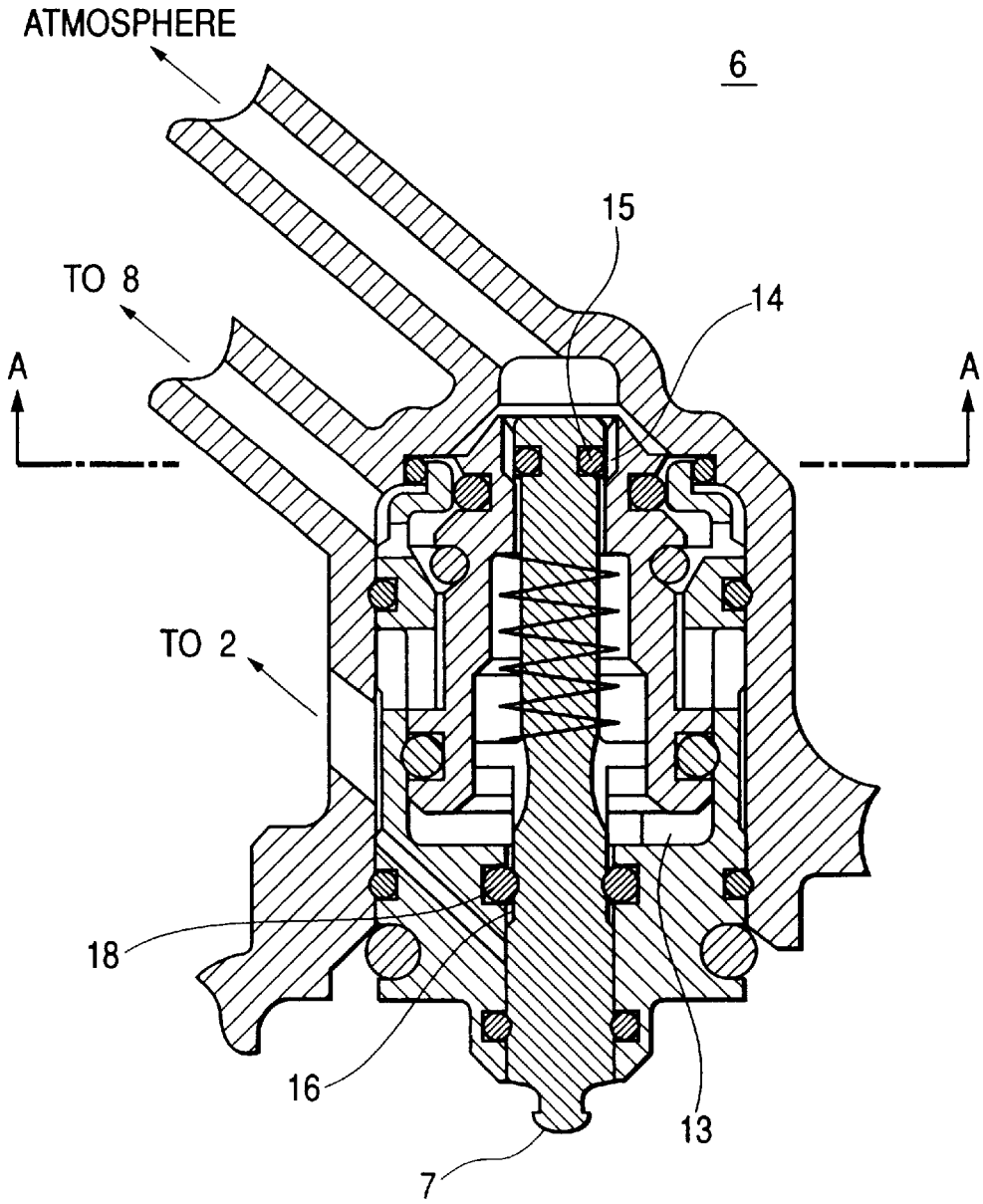
FIG. 3 is a vertical cross-sectional view showing another condition of the trigger valve apparatus shown in FIG. 2, wherein a plunger is pushed up from the initial condition of FIG. 2.
Figure 4:
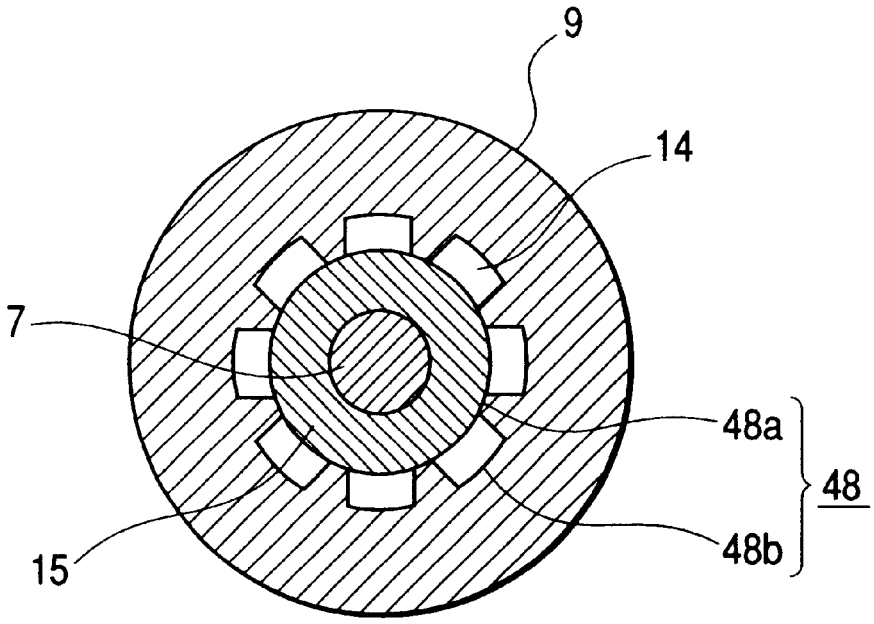
FIG. 4 is a transverse cross-sectional view showing the trigger valve apparatus shown in FIG. 2, taken along a line A—A of FIG. 3.

According to the arrangement of the trigger valve apparatus shown in FIGS. 2 to 4, a plurality of axial grooves 48*b* are formed partly on the inner cylindrical wall of the axial bore of the valve piston 9. These grooves 48*b* extend in the axial direction of the valve piston 9 and are angularly spaced each other so as to form a plurality of guide ridges 48*a* spaced at substantially equal intervals on the inner cylindrical wall of the axial bore of the valve piston 9. These guide ridges 48*a* cooperatively define an effective diameter of the axial bore of the valve piston 9 along which the O-ring 15 is guided. A total cross section of the axial grooves 48*b*, formed when the O-ring 15 is engaged in the axial bore of the valve piston 9, defines an effective area of a relief passage through which compressed air can flow from the valve piston chamber 13 to the outside (i.e., the atmosphere) under the condition where the valve piston 9 is brought into contact with the O-ring 15. In other words, the plurality of (e.g., eight) axial grooves 48*b* form the relief passage as part of the air passage 14. The guide ridges 48*a* and the axial grooves 48*b* cooperatively constitute a relief passage portion 48 on the surface of the axial bore of the valve piston 9.

According to this arrangement, the air passage 14 substantially opens when the O-ring 15 of the plunger 7 reaches the relieve passage portion 48 consisting of axially extending and alternately arranged guide ridges 48*a* and grooves 48*b*. The compressed air in the valve piston chamber 13 is discharged to the outside (i.e., the atmosphere) via the axial grooves 48*b* (i.e., relief passage). At this moment, the O-ring 15 receives a pressure of exhaust air. However, the O-ring 15 is firmly held by the guide ridges 48*a* so as not to be pulled off the engaging recess of the plunger 7 by the exhaust air. Accordingly, the hardness of the O-ring 15 needs not be increased to prevent the O-ring 15 from falling. Thus, the sliding characteristics of the plunger 7 is not worsened. And, the O-ring 15 can be surely coupled in the engaging recess of the plunger 7.

Figure 6:
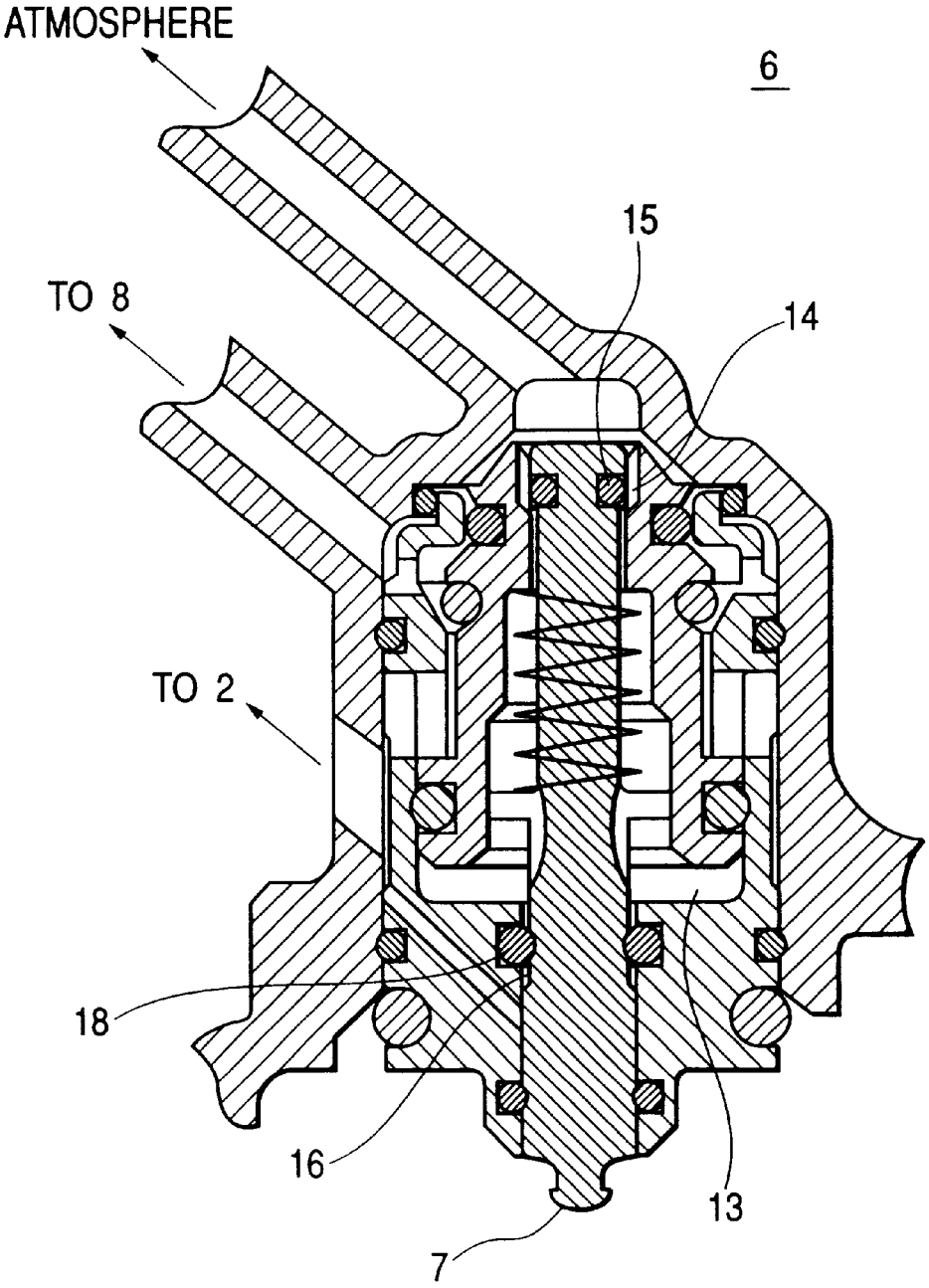
FIG. 6 is a vertical cross-sectional view showing another condition of the trigger valve apparatus shown in FIG. 5, wherein the plunger is pushed up from the initial condition of FIG. 5.
Figure 7:
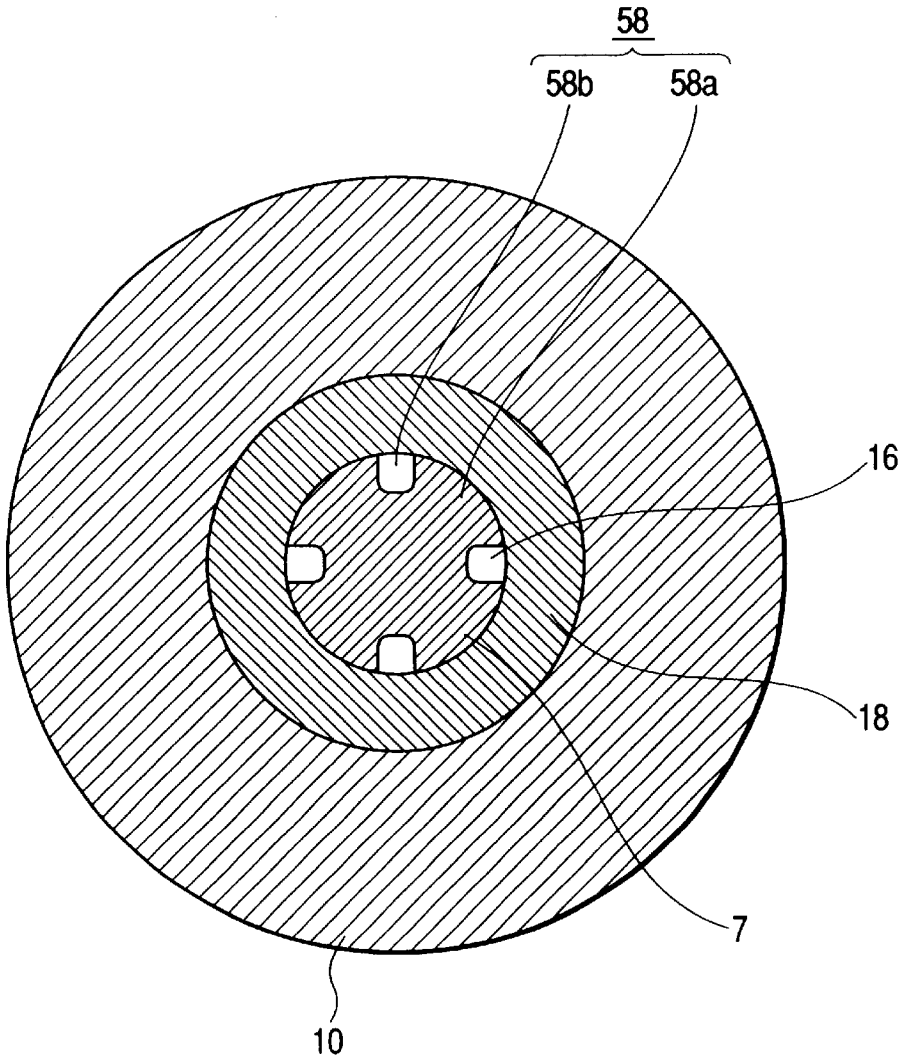
FIG. 7 is a transverse cross-sectional view showing the trigger valve apparatus shown in FIG. 5, taken along a line B—B of FIG. 5.

Next, another preferable embodiment of the trigger valve apparatus is explained with reference to FIGS. 5 to 7.

A plurality of axial grooves 58*b* are formed partly on the lower cylindrical surface of the plunger 7. These grooves 58*b* extend in the axial direction of the plunger 7 and are angularly spaced each other so as to leave a plurality of cylindrical guide surfaces 58*a* spaced at substantially equal intervals on the lower cylindrical surface of the plunger 7.

The lower cylindrical surface of the plunger 7 is brought into contact with the O-ring 18 coupled in the engaging recess of the valve bush 10 when the plunger 7 is positioned at its top dead center. These guide surfaces 58*a* cooperatively define a guide surface along which the O-ring 18 slides. A total cross section of the axial grooves 58*b*, formed when the O-ring 18 is brought into contact with the plunger 7, defines an effective area of a relief passage through which compressed air can flow into the valve piston chamber 13 from the accumulator chamber 2 under the condition where the plunger 7 is brought into contact with the O-ring 18. In other words, the plurality of (e.g., four) axial grooves 58*b* form the relief passage as part of the air passage 16. The guide surfaces 58*a* and the axial grooves 58*b* cooperatively constitute a relief passage portion 58 on the lower cylindrical surface of the plunger 7.

According to this arrangement, the air passage 16 substantially opens when the O-ring 18 is positioned at the relief passage portion 58 consisting of axially extending and alternately arranged guide surfaces 58*a* and grooves 58*b*. The compressed air of the accumulator chamber 2 can enter into the valve piston chamber 13 via the axial grooves 58*b*

(i.e., the relief passage). At this moment, the O-ring 18 receives a pressure of intake air. However, the O-ring 18 is firmly held by the guide surfaces 58*a* so as not to be pulled off the engaging recess of the valve bush 10 by the intake air. Accordingly, the hardness of the O-ring 18 needs not be increased to prevent the O-ring 18 from falling. The sliding characteristics of the plunger 7 is not worsened. And, the O-ring 18 can be surely coupled in the engaging recess of the valve bush 10.

The arrangement of the relief passage is not limited to the above-described embodiments.

Next, another preferable embodiments of the trigger valve apparatus will be explained with reference to FIGS. 15 to 16.

Figure 15:
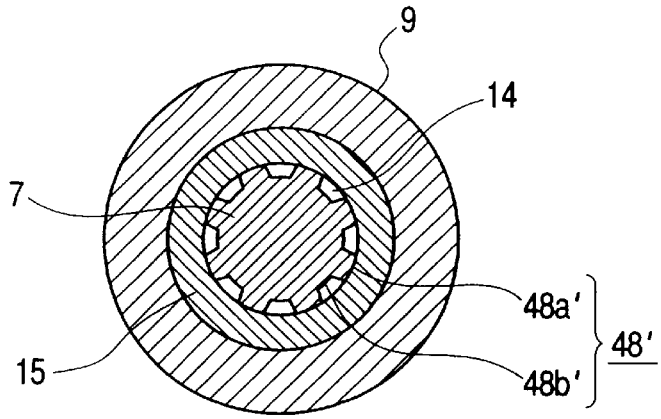
FIG. 15 is a transverse cross-sectional view showing another trigger valve apparatus in accordance with a preferred embodiment of the present invention, similar to FIG. 4 which is taken along a line A—A of FIG. 3.

According to the arrangement of the trigger valve apparatus shown in FIG. 15, the O-ring 15 is coupled in an engaging recess forced on an inner cylindrical wall of the axial bore of the valve piston 9. A plurality of axial grooves 48'*b* are formed partly on the upper cylindrical surface of the plunger 7. These grooves 48'*b* extend in the axial direction of the plunger 7 and are angularly spaced each other so as to form a plurality of guide ridges 48'*a* spaced at substantially equal intervals on the upper cylindrical surface of the plunger 7.

A total cross section of the axial grooves 48'*b*, formed when the O-ring 15 is brought into contact with the plunger 7, defines an effective area of a relief passage through which compressed air can flow from the valve piston chamber 13 to the outside (i.e., the atmosphere). In other words, the plurality of (e.g., eight) axial grooves 48'*b* form the relief passage as part of the air passage 14. The guide ridges 48'*a* and the axial grooves 48'*b* cooperatively constitute a relief passage portion 48' on the upper cylindrical surface of the plunger 7.

The rest of the trigger valve apparatus shown in FIG. 15 is substantially the same as that of the trigger valve apparatus shown in FIG. 2.

According to this arrangement, the air passage 14 substantially opens when the O-ring 15 coupled in the axial bore of the valve piston 9 meets the relieve passage portion 48' formed on the upper cylindrical surface of the plunger 7 which consists of axially extending and alternately arranged guide ridges 48'*a* and grooves 48'*b*. The compressed air in the valve piston chamber 13 is discharged to the outside (i.e., the atmosphere) via the axial grooves 48'*b* (i.e., relief passage). At this moment, the O-ring 15 receives a pressure of exhaust air. However, the O-ring 15 is firmly held by the guide ridges 48'*a* so as not to be pulled off the engaging recess of the valve piston 9 by the exhaust air. Accordingly, the hardness of the O-ring 15 needs not be increased to prevent the O-ring 15 from falling. Thus, the sliding characteristics of the plunger 7 is not worsened. And, the O-ring 15 can be surely coupled in the engaging recess of the valve piston 9.

Figure 16:
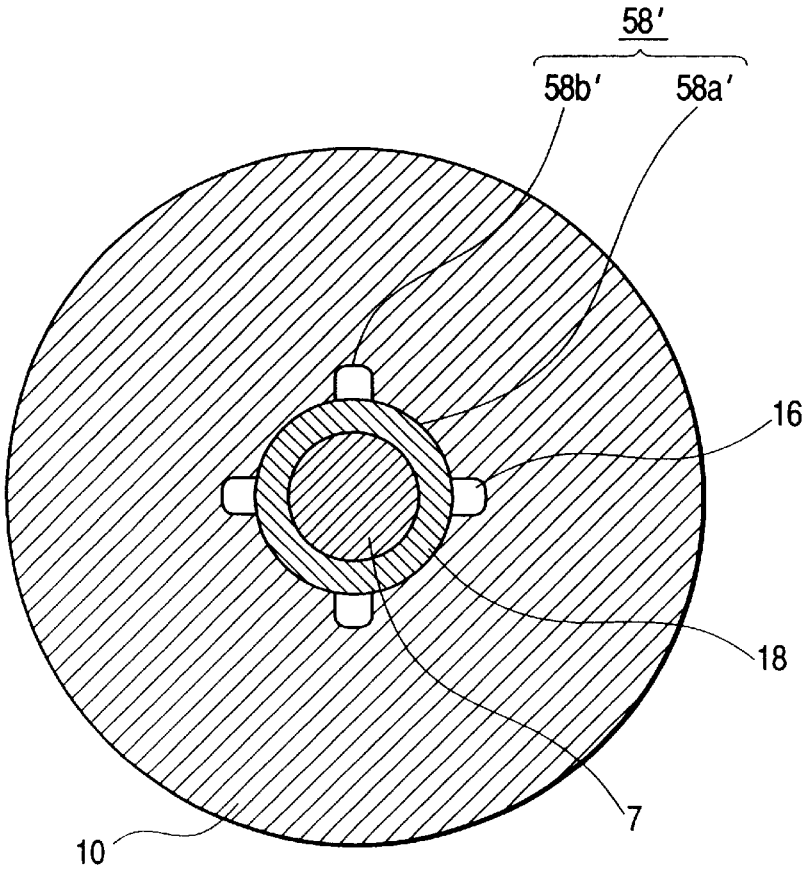
FIG. 16 is a transverse cross-sectional view showing another trigger valve apparatus in accordance with a preferred embodiment of the present invention, similar to FIG. 7 which is taken along a line B—B of FIG. 5.
Figure 17:
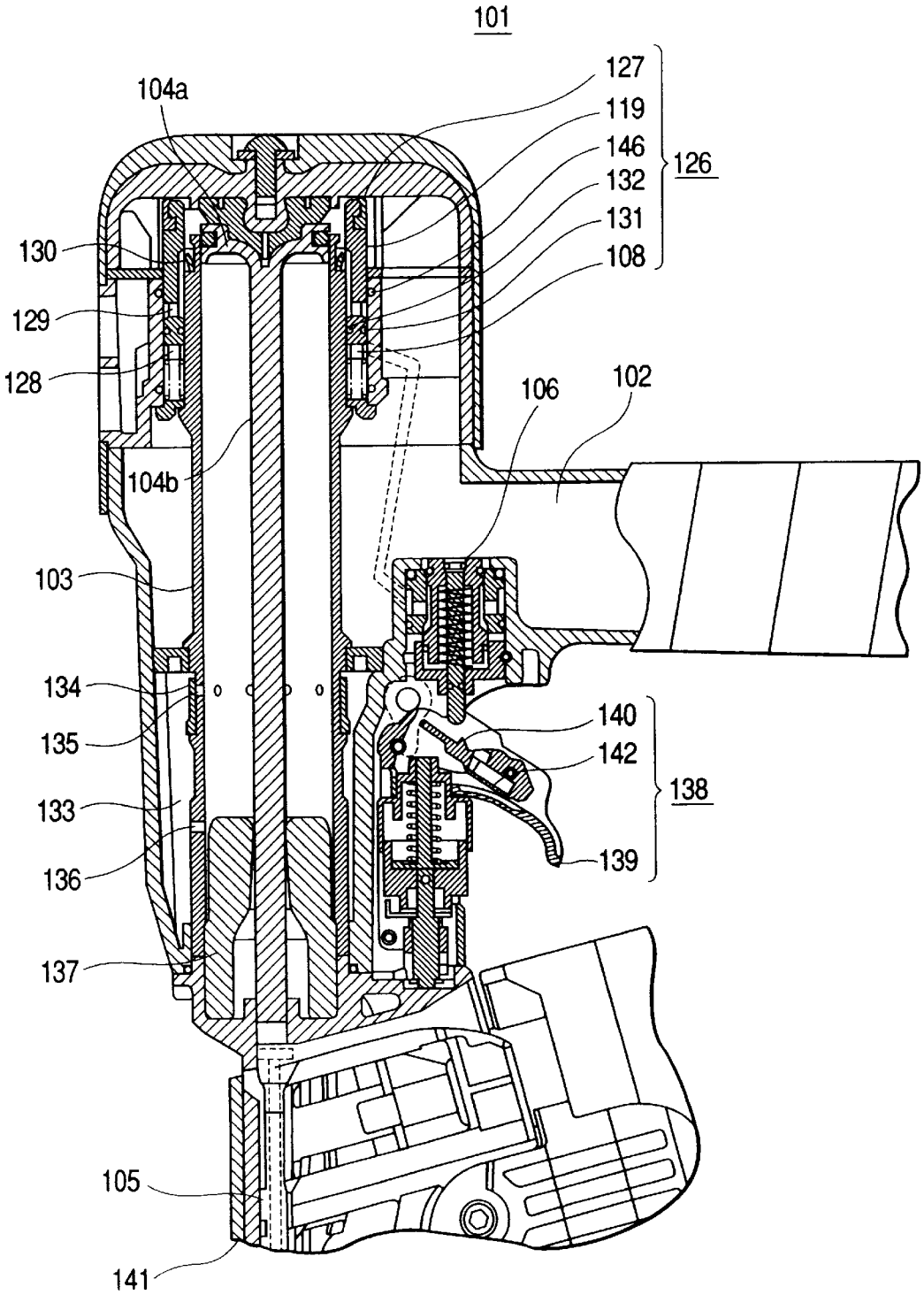
FIG. 17 PRIOR ART
FIG. 17 is a vertical partly cross-sectional view showing a conventional pneumatic fastener.
Figure 18:
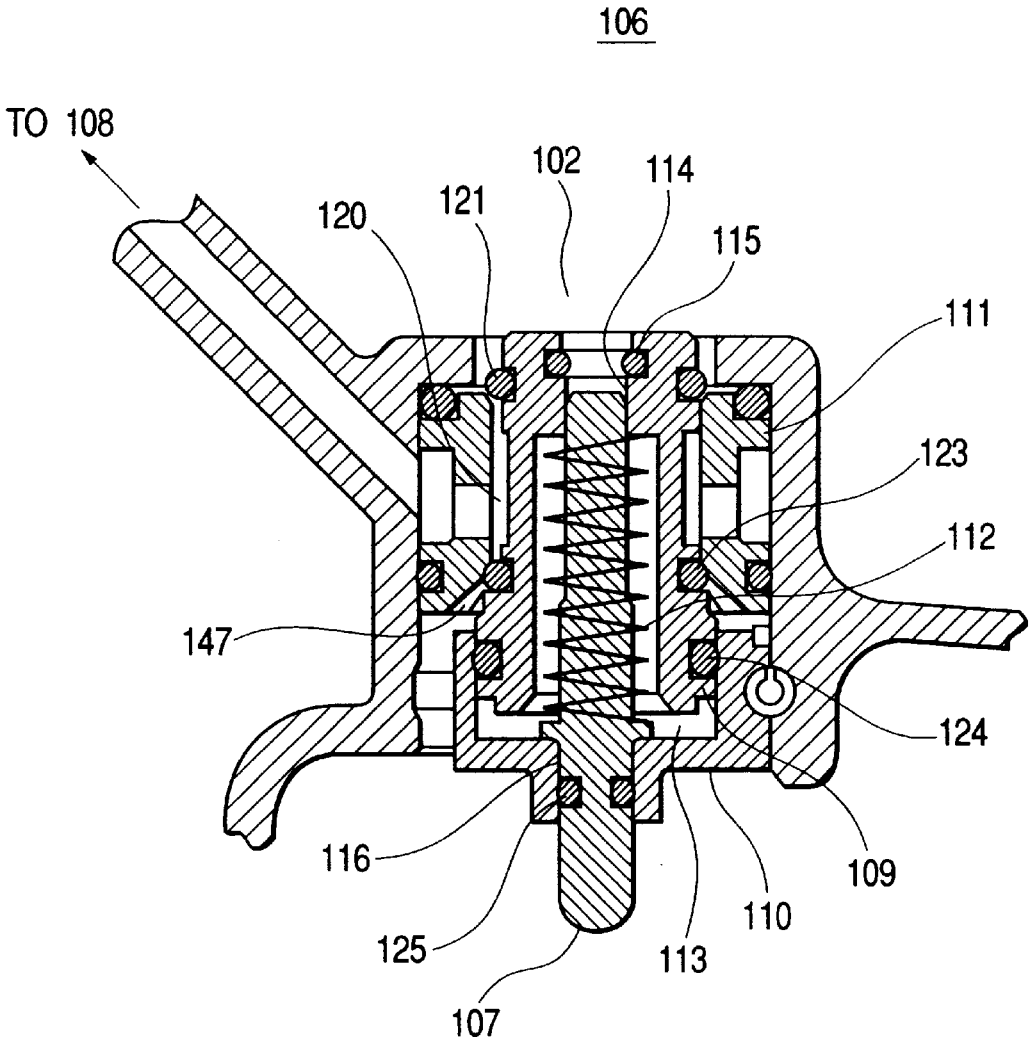
FIG. 18 PRIOR ART
FIG. 18 is a vertical cross-sectional view showing an initial condition of a trigger valve apparatus employed in the conventional pneumatic fastener.
Figure 19:
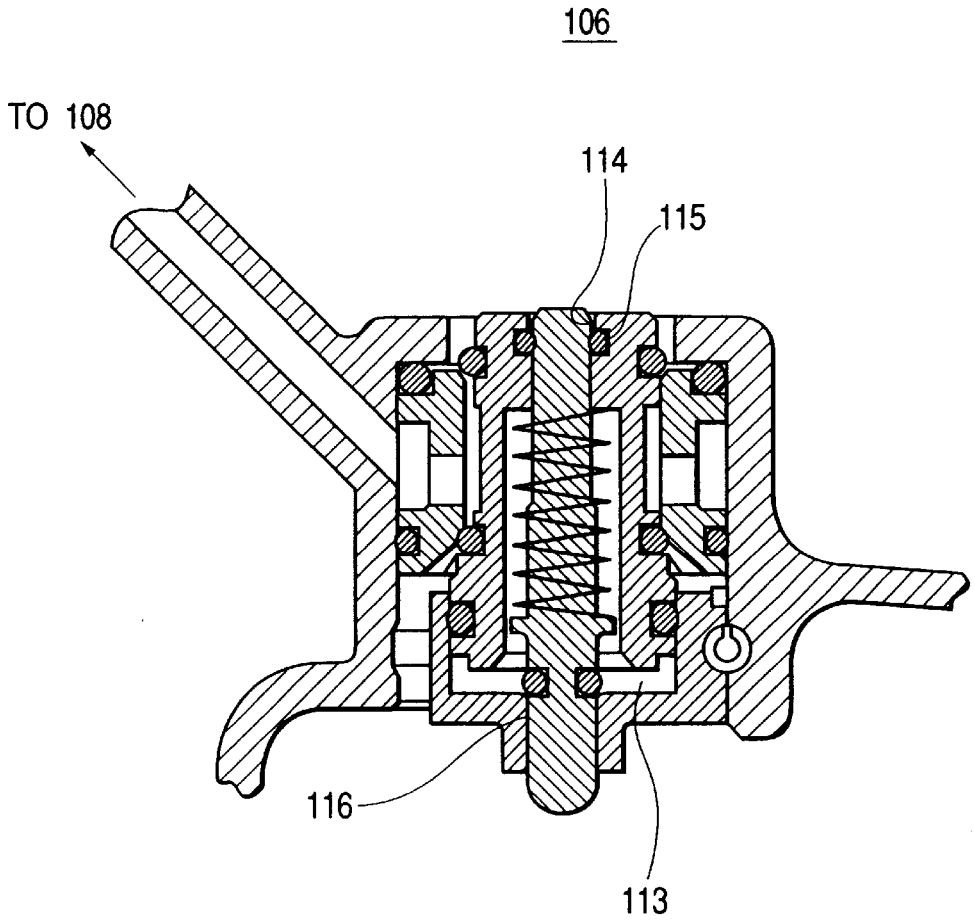
FIG. 19 PRIOR ART
FIG. 19 is a vertical cross-sectional view showing another condition of the trigger valve apparatus shown in FIG. 18, wherein a plunger is pushed up from the initial condition shown in FIG. 18.
Figure 20:
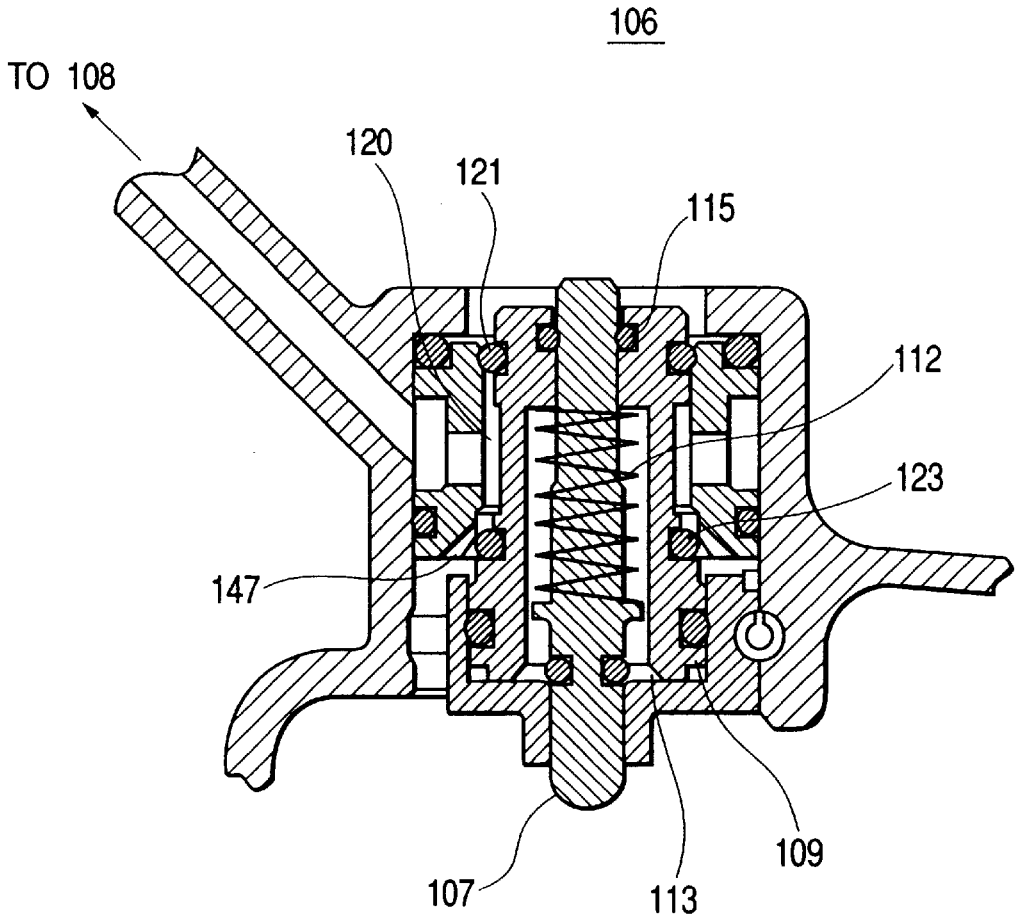
FIG. 20 PRIOR ART
FIG. 20 is a vertical cross-sectional view showing another condition of the trigger valve apparatus shown in FIG. 18, where a valve piston has moved to its bottom dead center from the condition shown in FIG. 19.
Figure 21:
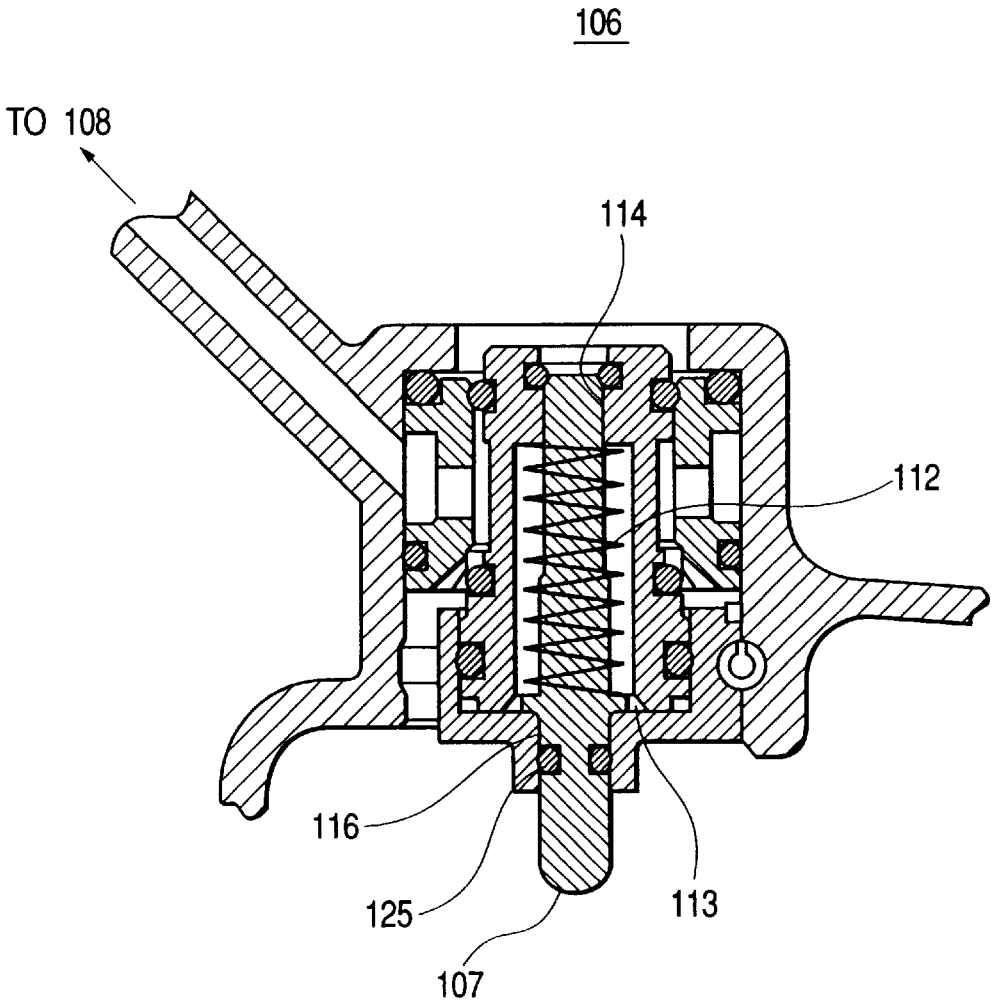
FIG. 21 PRIOR ART
FIG. 21 is a vertical cross-sectional view showing another condition of the trigger valve apparatus shown in FIG. 18, where the plunger is returned to an original position from the condition shown in FIG. 20.

Next, according to the arrangement of the trigger valve apparatus shown in FIG. 16, the O-ring 18 is coupled in an engaging recess forced around the lower cylindrical surface of the plunger 7. A plurality of axial grooves 58'*b* are formed partly on a cylindrical bore of the valve bush 10. These grooves 58'*b* extend in the axial direction of the valve bush 10 and are angularly spaced each other so as to leave a plurality of cylindrical guide surfaces 58'*a* spaced at substantially equal intervals on the axial bore of the valve bush 10.

The guide surfaces 58'*a* cooperatively define a guide surface along which the O-ring 18 of the plunger 7 slides. A total cross section of the axial grooves 58'*b*, formed when the O-ring 18 is brought into contact with the axial bore of the valve bush 10, defines an effective area of a relief passage through which compressed air can flow into the valve piston chamber 13 from the accumulator chamber 2. In other words, the plurality of (e.g., four) axial grooves 58'*b* form the relief passage as part of the air passage 16. The guide surfaces 58'*a* and the axial grooves 58'*b* cooperatively constitute a relief passage portion 58' on the axial bore of the valve bush 10.

Figure 5:
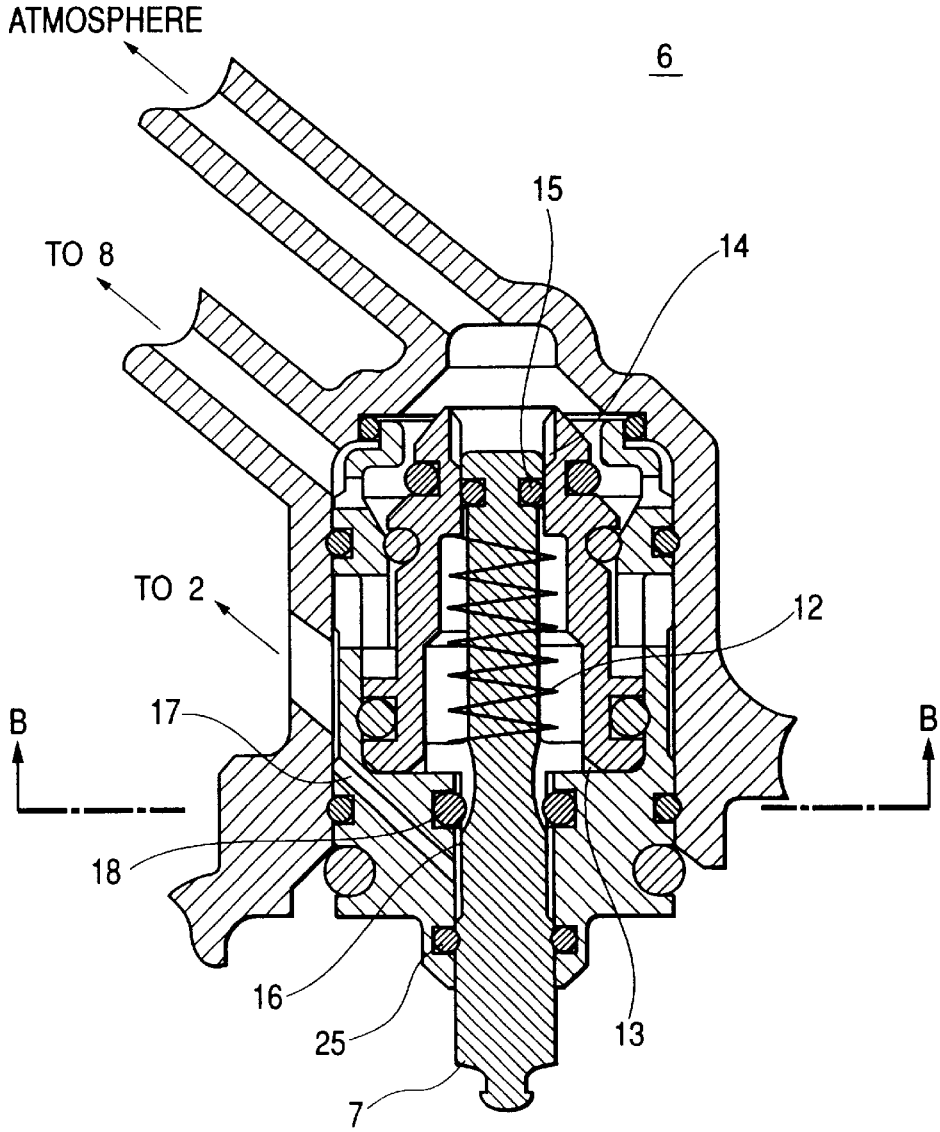
FIG. 5 is a vertical cross-sectional view showing an initial condition of another trigger valve apparatus in accordance with a preferred embodiment of the present invention.

The rest of the trigger valve apparatus shown in FIG. 16 is the same as that of the trigger valve apparatus shown in FIG. 5.

According to this arrangement, the air passage 16 substantially opens when the O-ring 18 is positioned at the relief passage portion 58' consisting of axially extending and alternately arranged guide surfaces 58'*a* and grooves 58'*b*. The compressed air of the accumulator chamber 2 can enter into the valve piston chamber 13 via the axial grooves 58'*b* (i.e., the relief passage). At this moment, the O-ring 18 receives a pressure of intake air. However, the O-ring 18 is firmly held by the guide surfaces 58'*a* so as not to be pulled off the engaging recess of the plunger 7 by the intake air. Accordingly, the hardness of the O-ring 18 needs not be increased to prevent the O-ring 18 from falling. The sliding characteristics of the plunger 7 is not worsened. And, the O-ring 18 can be surely coupled in the engaging recess of the plunger 7.

In the above-described embodiments of FIGS. 15 and 16, the diameters of the O-rings 15 and 18 and the resilient force of the spring 12 should be adequately determined so that the plunger 7 and the valve piston 9 can operate properly as intended.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A trigger valve apparatus for a pneumatic tool driven by compressed air to drive a nail or similar member, said trigger valve apparatus comprising:

a plunger shiftable in response to a trigger operation by a user;

a valve piston having a valve piston chamber therein for slidably accommodating said plunger and an axial bore into which said plunger is inserted, said valve piston being shiftable to control the compressed air supplied to or discharged from said pneumatic tool;

an air passage connecting said valve piston chamber to an atmosphere via a clearance between said plunger and said axial bore of said valve piston;

a seal member provided to seal said clearance between said plunger and said axial bore of said valve piston; and a relief passage formed on at least one of said plunger and said axial bore of said valve piston to open said air passage, said relief passage including means for allowing compressed air to exit from said valve piston chamber to the atmosphere under a condition where said plunger is engaged with said axial bore of said valve piston.

2. The trigger valve apparatus for a pneumatic tool defined in claim 1, wherein said seal member is coupled around said plunger and guided along said axial bore of said valve piston.

3. The trigger valve apparatus for a pneumatic tool defined in claim 2, where said relief passage is formed at least partly on a surface of said axial bore of said valve piston so as to open said air passage when said plunger is positioned at a predetermined position to discharge compressed air from said valve piston chamber to the atmosphere under a condition where said seal member is brought into contact with said axial bore of said valve piston.

4. The trigger valve apparatus for a pneumatic tool defined in claim 1, wherein said seal member is coupled in an engaging recess of said axial bore of said valve piston.

5. The trigger valve apparatus for a pneumatic tool defined in claim 4, where said relief passage is formed at least partly on a cylindrical surface of said plunger so as to open said air passage when said plunger is positioned at a predetermined position to discharge compressed air from said valve piston chamber to the atmosphere under a condition where said seal member is brought into contact with said plunger.

6. The trigger valve apparatus for a pneumatic tool defined by claim 4, wherein said relief passage consists of axially extending and alternately arranged guides and grooves formed on the cylindrical surface of said plunger.

7. The trigger valve apparatus for a pneumatic tool defined by claim 6, wherein said grooves extend in an axial direction of said plunger and are angularly spaced from each other so as to form said guides spaced at substantially equal intervals on the cylindrical surface of said plunger.

8. The trigger valve apparatus for a pneumatic tool defined by claim 7, wherein said guides cooperatively define an effective diameter of said plunger.

9. A trigger valve apparatus for a pneumatic tool driven by compressed air to drive a nail or similar member, said trigger valve apparatus comprising:

a plunger shiftable in response to a trigger operation by a user;

a valve piston having a valve piston chamber therein for slidably accommodating said plunger and an axial bore into which said plunger is inserted, said valve piston being shiftable to control the compressed air supplied to or discharged from said pneumatic tool;

an air passage connecting said valve piston chamber to an atmosphere via a clearance between said plunger and said axial bore of said valve piston;

a seal member provided to seal said clearance between said plunger and said axial bore of said valve piston; and a relief passage formed on at least one of said plunger and said axial bore of said valve piston to open said air passage, thereby allowing compressed air to exit from said valve piston chamber to the atmosphere under a condition where said plunger is engaged with said axial bore of said valve piston, wherein said seal member is coupled in an engaging recess of said axial bore of said valve piston, wherein said relief passage consists of axially extending and alternately arranged guides and grooves fanned on the cylindrical surface of said plunger, and wherein a total cross section of said grooves, formed when said plunger is guided by said seal member provided on said axial bore of said valve piston, defines an effective area of said relief passage.

10. The trigger valve apparatus for a pneumatic tool defined by claim 6, wherein said guides hold said seal member while the compressed air is discharged from said valve piston chamber to the atmosphere via said grooves when said air passage is opened via said relief passage.

11. The trigger valve apparatus for a pneumatic tool defined by claim 1, wherein said seal member is an O-ring.

12. A trigger valve apparatus for a pneumatic tool driven by compressed air to drive a nail or similar member, said trigger valve apparatus comprising:

a plunger shiftable in response to a trigger operation by a user;

a valve piston having a valve piston chamber therein for slidably accommodating said plunger and an axial bore into which said plunger is inserted, said valve piston being shiftable to control the compressed air supplied to or discharged from said pneumatic tool;

an air passage connecting said valve piston chamber to an atmosphere via a clearance between said plunger and said axial bore of said valve piston;

a seal member provided to seal said clearance between said plunger and said axial bore of said valve piston; and a relief passage formed on at least one of said plunger and said axial bore of said valve piston to open said air passage, thereby allowing compressed air to exit from said valve piston chamber to the atmosphere under a condition where said plunger is engaged with said axial bore of said valve piston, wherein said seal member is coupled around said plunger and guided along said axial bore of said valve piston, and wherein said relief passage consists of axially extending and alternately arranged guides and grooves formed on said axial bore of said valve piston.

13. The trigger valve apparatus for a pneumatic tool defined by claim 12, wherein said grooves extended in an axial direction of said valve piston and are angularly spaced from each other so as to form said guides spaced at substantially equal intervals on the surface of said axial bore of said valve piston.

14. The trigger valve apparatus for a pneumatic tool defined by claim 12, wherein said guides cooperatively define an effective diameter of said axial bore of said valve piston along which said seal member is guided.

15. The trigger valve apparatus for a pneumatic tool defined by claim 12, wherein a total cross section of said grooves, formed when said seal member is guided in said axial bore of said valve piston, defines an effective area of said relief passage.

16. The trigger valve apparatus for a pneumatic tool defined by claim 12, wherein said guides hold said seal member while the compressed air is discharged from said valve piston chamber to the atmosphere via said grooves when said air passage is opened via said relief passage.

17. A trigger valve apparatus for a pneumatic tool driven by compressed air to drive a nail or similar member, said trigger valve apparatus comprising:

a plunger shiftable in response to a trigger operation by a user;

a valve bush having an axial bore into which said plunger is slidably inserted;

a valve piston slidably supported by said valve bush to form a valve piston chamber for slidably accommodating said plunger, said valve piston being shiftable to control the compressed air supplied to or discharged from said pneumatic tool;

an air passage connecting said valve piston chamber to an accumulator chamber via a clearance between said plunger and said axial bore of said valve bush;

a seal member provided to seal said clearance between said plunger and said axial bore of said valve bush; and a relief passage formed on at least one of said plunger and said axial bore of said valve bush to open said air passage, said relief passage including means for allowing compressed air to enter into said valve piston chamber from said accumulator chamber under a condition where said plunger is engaged with said axial bore of said valve bush.

18. The trigger valve apparatus for a pneumatic tool defined in claim 17, wherein said seal member is coupled in an engaging recess of said axial bore of said valve bush.

19. The trigger valve apparatus for a pneumatic tool defined in claim 18, where said relief passage is formed at least partly on a cylindrical surface of said plunger so as to open said air passage when said plunger is positioned at a predetermined position to introduce compressed air from said accumulator chamber to said valve piston chamber under a condition where said seal member is brought into contact with said plunger.

20. The trigger valve apparatus for a pneumatic tool defined by claim 18, wherein said relief passage consists of axially extending and alternately arranged guides and grooves formed on the cylindrical surface of said plunger.

21. The trigger valve apparatus for a pneumatic tool defined by claim 20, wherein said grooves extend in an axial direction of said plunger and are angularly spaced each other so as to form said guides spaced at substantially equal intervals on the cylindrical surface of said plunger.

22. The trigger valve apparatus for a pneumatic tool defined by claim 20, wherein said guides cooperatively define an effective diameter of said plunger.

23. The trigger valve apparatus for a pneumatic tool defined by claim 20, wherein said guides hold said seal member while the compressed air is introduced via said grooves into, said valve piston chamber from said accumulator chamber when said air passage is opened via said relief passage.

24. The trigger valve apparatus for a pneumatic tool defined in claim 17, wherein said seal member is coupled around said plunger and guided along said axial bore of said valve bush.

25. The trigger valve apparatus for a pneumatic tool defined in claim 24, where said relief passage is formed at least partly on a surface of said axial bore of said valve bush so as to open said air passage when said plunger is positioned at a predetermined position to introduce compressed air from said accumulator chamber to said valve piston chamber under a condition where said seal member is brought into contact with said axial bore of said valve bush.

26. The trigger valve apparatus for a pneumatic tool defined by claim 17, wherein said seal member is an O-ring.

27. A trigger valve apparatus for a pneumatic tool driven by compressed air to drive a nail or similar member, said trigger valve apparatus comprising:

a plunger shiftable in response to a trigger operation by a user;

a valve bush having an axial bore into which said plunger is slidably inserted;

a valve piston slidably supported by said valve bush to form a valve piston chamber for slidably accommodating said plunger, said valve piston being shiftable to control the compressed air supplied to or discharged from said pneumatic tool;

an air passage connecting said valve piston chamber to an accumulator chamber via a clearance between said plunger and said axial bore of said valve bush;

a seal member provided to seal said clearance between said plunger and said axial bore of said valve bush; and a relief passage formed on at least one of said plunger and said axial bore of said valve bush to open said air passage, thereby allowing compressed air to enter into said valve piston chamber from said accumulator chamber under a condition where said plunger is engaged with said axial bore of said valve bush, wherein said seal member is coupled around said plunger and guided along said axial bore of said valve bush, and wherein said relief passage consists of axially extending and alternately arranged guides and grooves formed on said axial bore of said valve bush.

28. The trigger valve apparatus for a pneumatic tool defined by claim 27, wherein said grooves extend in an axial direction of said valve piston and are angularly spaced from each other so as to form said guides spaced at substantially equal intervals on the surface of said axial bore of said valve bush.

29. The trigger valve apparatus for a pneumatic tool defined by claim 27, wherein said guides cooperatively define an effective diameter of said axial bore of said valve bush along which said seal member is guided.

30. The trigger valve apparatus for a pneumatic tool defined by claim 27, wherein a total cross section of said grooves, formed when said seal member is guided in said axial bore of said valve bush, defines an effective area of said relief passage.

31. The trigger valve apparatus for a pneumatic tool defined by claim 27, wherein said guides hold said seal member while the compressed air is introduced via said grooves into said valve piston chamber from said accumulator chamber when said air passage is opened via said relief passage.

32. A trigger valve apparatus for a pneumatic tool driven by compressed air to drive a nail or similar member, said trigger valve apparatus comprising:

a plunger shiftable in response to a trigger operation by a user;

a valve bush having an axial bore into which said plunger is slidably inserted;

a valve piston slidably supported by said valve bush to form a valve piston chamber for slidably accommodating said plunger, said valve piston being shiftable to control the compressed air supplied to or discharged from said pneumatic tool;

an air passage connecting said valve piston chamber to an accumulator chamber via a clearance between said plunger and said axial bore of said valve bush;

a seal member provided to seal said clearance between said plunger and said axial bore of said valve bush; and a relief passage formed on at least one of said plunger and said axial bore of said valve bush to open said air passage, thereby allowing compressed air to enter into said valve piston chamber from said accumulator chamber under a condition whore said plunger is engaged with said axial bore of said valve bush, wherein said seal member is coupled in an engaging recess of said axial bore of said valve bush, wherein said relief passage consists of axially extending and alternately arranged guides and grooves formed on the cylindrical surface of said plunger, and wherein a total cross section of said grooves, formed when said plunger is guided by said seal member provided on said axial bore of said valve bush, defines an effective area of said relief passage.

33. A trigger valve apparatus for a pneumatic tool driven by compressed air to drive a nail or similar member, said trigger valve apparatus comprising:

a plunger shiftable in response to a trigger operation by a user;

a valve piston having a valve piston chamber therein for slidably accommodating said plunger and an axial bore into which said plunger is inserted, said valve piston being shiftable to control the compressed air supplied to or discharged from said pneumatic tool;

an air passage connecting said valve piston chamber to an atmosphere via a clearance between said plunger and said axial bore of said valve piston;

a seal member provided to seal said clearance between said plunger and said axial bore of said valve piston; and a relief passage formed on at least one of said plunger and said axial bore of said valve piston to open said air passage, said relief passage provides means for allowing compressed air to exit from said valve piston chamber to the atmosphere under a condition where said valve piston is configured in the top-dead-center position and said plunger is engaged with said axial bore of said valve piston.

34. A trigger valve apparatus for a pneumatic tool driven by compressed air to drive a nail or similar member, said trigger valve apparatus comprising:

a plunger shiftable in response to a trigger operation by a user;

a valve bush having an axial bore into which said plunger is slidably inserted;

a valve piston slidably supported by said valve hush to form a valve piston chamber for slidably accommodating said plunger, said valve piston being shiftable to control the compressed air supplied to or discharged from said pneumatic tool;

an air passage connecting said valve piston chamber to an accumulator chamber via a clearance between said plunger and said axial bore of said valve bush;

a seal member provided to seal said clearance between said plunger and said axial bore of said valve bush; and a relief passage formed on at least one of said plunger and said axial bore of said valve bush to open said air passage, said relief passage providing means for allowing compressed air to enter into said valve piston chamber from said accumulator chamber under a condition where said valve piston is configured in the top-dead-center position and said plunger is engaged with said axial bore of said valve bush.

* * * * *

UNITED STATES PATENT AND TRADEMARK OFFICE

CERTIFICATE OF CORRECTION

PATENT NO. : 6,745,928 B2
APPLICATION NO. : 09/767823
DATED : June 8, 2004
INVENTOR(S) : Yoshinori Ishizawa et al.

It is certified that error appears in the above-identified patent and that said Letters Patent is hereby corrected as shown below:

On the 1st Page of Letters Patent:

At (73) the name of Assignee should read as follows:

-- Hitachi Koki Co., Ltd. (JP) --

Signed and Sealed this

First Day of August, 2006

JON W. DUDAS
*Director of the United States Patent and Trademark Office*